US010866550B2

(12) United States Patent
Kawaguchi et al.

(10) Patent No.: US 10,866,550 B2
(45) Date of Patent: Dec. 15, 2020

(54) FIXING DEVICE CAPABLE OF IMPROVING HEATING EFFICIENCY OF FIXING BELT, IMAGE FORMING APPARATUS

(71) Applicant: KYOCERA Document Solutions Inc., Osaka (JP)

(72) Inventors: Kotatsu Kawaguchi, Osaka (JP); Rina Kikugawa, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/803,780

(22) Filed: Feb. 27, 2020

(65) Prior Publication Data

US 2020/0278628 A1 Sep. 3, 2020

(30) Foreign Application Priority Data

Feb. 28, 2019 (JP) ..... 2019-036073

(51) Int. Cl.
*G03G 15/20* (2006.01)

(52) U.S. Cl.
CPC ..... *G03G 15/2053* (2013.01); *G03G 15/2025* (2013.01); *G03G 15/2064* (2013.01); *G03G 2215/2035* (2013.01)

(58) Field of Classification Search
CPC ..... G03G 15/2025; G03G 15/2053; G03G 15/2064; G03G 2215/2035
See application file for complete search history.

(56) References Cited

U.S. PATENT DOCUMENTS

2004/0151522 A1* 8/2004 Kato ..... G03G 15/2025 399/328
2008/0187372 A1* 8/2008 Kato ..... G03G 15/6591 399/328
2016/0216659 A1* 7/2016 Ikegami ..... G03G 15/2053
2017/0131664 A1* 5/2017 Utsunomiya ..... G03G 15/2053
2017/0219969 A1* 8/2017 Umeda ..... G03G 15/2039
2017/0364006 A1* 12/2017 Minemura ..... G03G 15/5054

FOREIGN PATENT DOCUMENTS

JP 2015166796 A 9/2015
JP 2018018045 A 2/2018

* cited by examiner

*Primary Examiner* — Carla J Therrien
(74) *Attorney, Agent, or Firm* — Alleman Hall Creasman & Tuttle LLP

(57) ABSTRACT

A fixing device includes a fixing belt, a pressure roller, a reserving portion, and a heater. The pressure roller is provided in contact with an outer peripheral surface of the fixing belt. The reserving portion is provided inside the fixing belt and configured to reserve a lubricant. The heater is provided between the reserving portion and the fixing belt in such a way as to be pressed against the fixing belt, wherein a moving path is formed in the heater such that the lubricant moves from the reserving portion toward the pressure roller in the moving path.

4 Claims, 13 Drawing Sheets

FIXING DEVICE CAPABLE OF IMPROVING HEATING EFFICIENCY OF FIXING BELT, IMAGE FORMING APPARATUS

INCORPORATION BY REFERENCE

This application is based upon and claims the benefit of priority from the corresponding Japanese Patent Application No. 2019-036073 filed on Feb. 28, 2019, the entire contents of which are incorporated herein by reference.

BACKGROUND

The present disclosure relates to an electrophotographic image forming apparatus, and to a fixing device provided in the image forming apparatus.

An electrophotographic image forming apparatus includes a fixing device that heats a sheet to which a toner image has been transferred, to fix the toner image to the sheet. For example, the fixing device includes a fixing belt, a pressure roller, a heater, and a nip forming member. The pressure roller is mounted in contact with an outer peripheral surface of the fixing belt. The heater applies heat to the fixing belt. The nip forming member is mounted to face the pressure roller across the fixing belt, and pressed against the fixing belt. A lubricant is applied to a contact surface of the nip forming member that comes in contact with the fixing belt.

In this type of fixing device, a friction force that acts between the contact surface of the nip forming member and the fixing belt may increase when the lubricant applied to the contact surface reduces. When the friction force increases, a problem may occur such as a noise, a disorder of print images, or a step-out of a driving portion that drives the pressure roller. There is known, as a related technology, a fixing device in which a lubricant is supplied from inside the nip forming member to an inner peripheral surface of the fixing belt.

SUMMARY

A fixing device according to an aspect of the present disclosure includes a fixing belt, a pressure roller, a reserving portion, and a heater. The pressure roller is provided in contact with an outer peripheral surface of the fixing belt. The reserving portion is provided inside the fixing belt and configured to reserve a lubricant. The heater is provided between the reserving portion and the fixing belt in such a way as to be pressed against the fixing belt, wherein a moving path is formed in the heater such that the lubricant moves from the reserving portion toward the pressure roller in the moving path.

An image forming apparatus according to another aspect of the present disclosure forms an image on a sheet by using the fixing device.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes embodiments of the present disclosure with reference to the accompanying drawings. It should be noted that the following embodiments are examples of specific embodiments of the present disclosure and should not limit the technical scope of the present disclosure.

[Configuration of Image Forming Apparatus 100]

Figure 1:
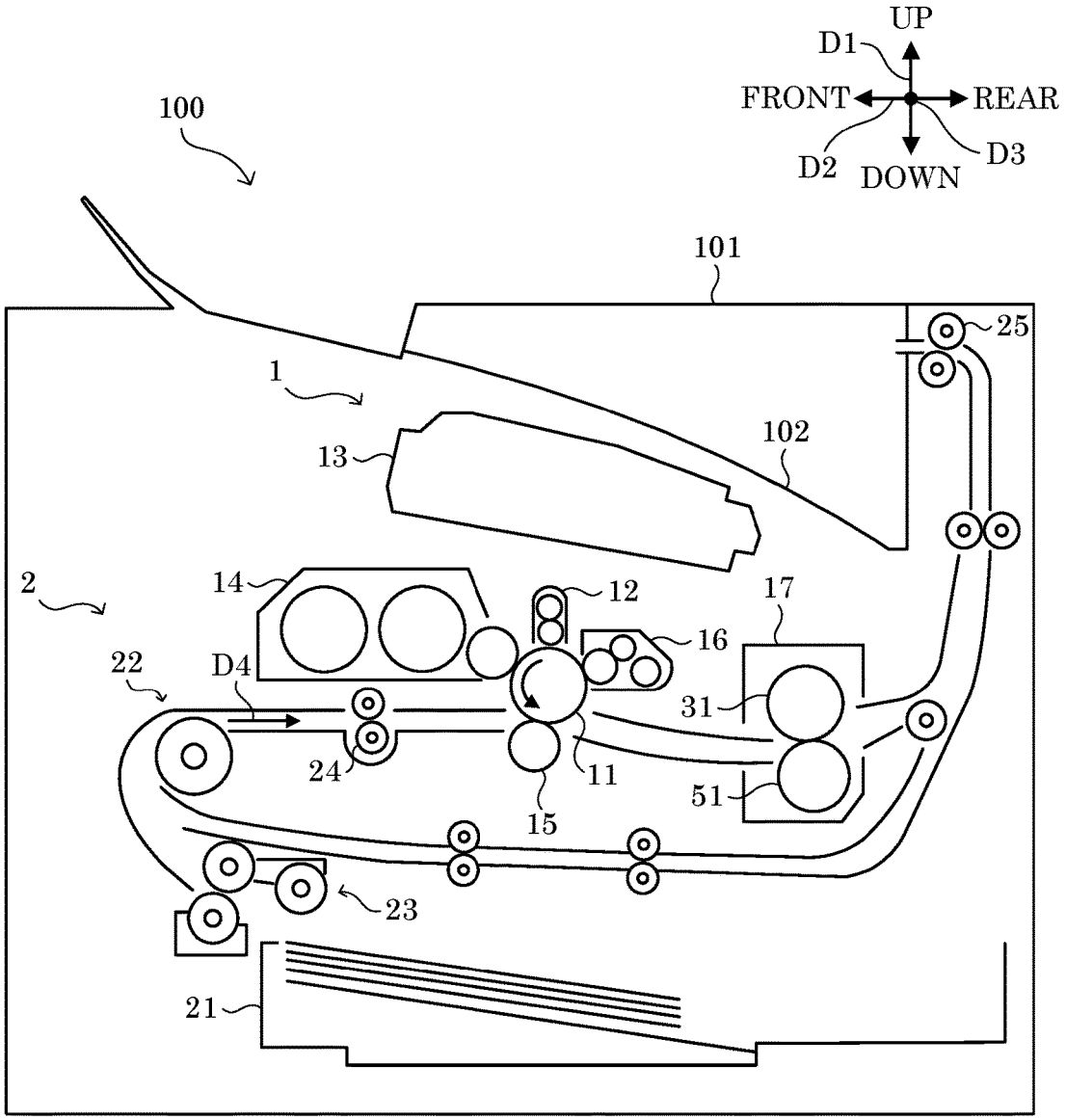
FIG. 1 is a diagram showing a configuration of an image forming apparatus.

First, a description is given of a configuration of an image forming apparatus 100 with reference to FIG. 1. Here, FIG. 1 is a cross-sectional diagram showing a configuration of the image forming apparatus 100.

For the sake of explanation, an up-down direction D1 is defined as a vertical direction in a state where the image forming apparatus 100 is installed usably (the state shown in FIG. 1). In addition, a front-rear direction D2 is defined on the supposition that the left-side surface of the image forming apparatus 100 shown in FIG. 1 is a front side (front). Furthermore, a left-right direction D3 is defined based on the image forming apparatus 100 in the installation state viewed from the front side.

The image forming apparatus 100 is a printer having a print function to form an image based on image data. It is noted that the present disclosure is applicable to image forming apparatuses such as a facsimile apparatus, a copier, and a multifunction peripheral.

As shown in FIG. 1, the image forming apparatus 100 includes an image forming portion 1 and a sheet conveying portion 2. The image forming portion 1 and the sheet conveying portion 2 are stored in a housing 101 of the image forming apparatus 100. The housing 101 is formed in an approximate shape of a rectangular parallelepiped. A sheet receiving portion 102 is formed in an upper portion of the housing 101, wherein a sheet with an image formed thereon by the image forming apparatus 100 is discharged to the sheet receiving portion 102.

The image forming portion 1 is configured to form an image by an electrophotographic method based on image data input from an external information processing apparatus such as a personal computer. As shown in FIG. 1, the image forming portion 1 includes a photoconductor drum 11, a charging device 12, a laser scanning unit 13, a developing device 14, a transfer roller 15, a cleaning device 16, and a fixing device 17.

The photoconductor drum 11 is rotatably supported by the housing 101. Upon receiving a rotational driving force transmitted from a motor (not shown), the photoconductor drum 11 rotates in a direction indicated by an arrow in FIG. 1. An electrostatic latent image is formed on the surface of the photoconductor drum 11.

The charging device 12 charges the surface of the photoconductor drum 11.

The laser scanning unit 13 irradiates light onto the charged surface of the photoconductor drum 11 based on the image data. The laser scanning unit 13 forms an electrostatic latent image on the surface of the photoconductor drum 11.

The developing device 14 develops, by using developer including toner, the electrostatic latent image formed on the surface of the photoconductor drum 11. The developing device 14 forms a toner image on the surface of the photoconductor drum 11.

The transfer roller 15 transfers the toner image formed on the surface of the photoconductor drum 11 to a sheet conveyed by the sheet conveying portion 2.

The cleaning device 16 cleans the surface of the photoconductor drum 11 after the toner image is transferred therefrom by the transfer roller 15.

The fixing device 17 heats the sheet to which the toner image has been transferred, and thereby fixes the toner image to the sheet. The fixing device 17 is any one of fixing devices 17A, 17B, 17C, 17D, 17E, and 17F that are described below.

The sheet conveying portion 2 conveys a sheet on which an image is formed by the image forming portion 1. As shown in FIG. 1, the sheet conveying portion 2 includes a sheet feed cassette 21, a sheet conveyance path 22, a sheet feed unit 23, a pair of registration rollers 24, and a pair of sheet discharge rollers 25.

The sheet feed cassette 21 stores sheets on which images are formed by the image forming portion 1. As shown in FIG. 1, the sheet feed cassette 21 is provided in a bottom portion of the housing 101. For example, the sheets stored in the sheet feed cassette 21 are sheet-like materials such as sheets of paper, sheets of coated paper, postcards, envelopes, and OHP sheets. The sheet feed cassette 21 includes a lift plate (not shown) for lifting a plurality of sheets stored therein.

The sheet conveyance path 22 is a sheet moving path that extends from the sheet feed cassette 21 to the sheet receiving portion 102, via the transfer roller 15 and the fixing device 17. A plurality of pairs of rollers, including the pair of registration rollers 24 and the pair of sheet discharge rollers 25, are provided in the sheet conveyance path 22. In the sheet conveyance path 22, a sheet fed from the sheet feed cassette 21 by the plurality of pairs of rollers is conveyed in a conveyance direction D4 (see FIG. 1) toward the sheet receiving portion 102. The sheet conveyance path 22 is formed by a pair of conveyance guide members provided in the housing 101.

The sheet feed unit 23 feeds the sheets stored in the sheet feed cassette 21 one by one to the sheet conveyance path 22. The sheet feed unit 23 includes a pickup roller, a sheet feed roller, and a retard roller. The pickup roller feeds a top sheet of the plurality of sheets lifted by the lift plate of the sheet feed cassette 21, to the sheet feed roller by rotating while in contact with an upper surface of the top sheet. The sheet feed roller feeds the sheet fed by the pickup roller to the sheet conveyance path 22 by rotating while in contact with the upper surface of the sheet. The retard roller is disposed below the sheet feed roller and biased toward the sheet feed roller. When a plurality of overlapping sheets are fed by the pickup roller, the retard roller separates sheets other than the top sheet from the plurality of overlapping sheets.

The pair of registration rollers 24 convey a sheet to a transfer position where a toner image is transferred to the sheet by the transfer roller 15 such that the sheet reaches the transfer position at the same timing as the toner image that is formed on the surface of the photoconductor drum 11 and carried by the rotation of the photoconductor drum 11.

The pair of sheet discharge rollers 25 discharge the sheet to which the toner image has been fixed by the fixing device 17, to the sheet receiving portion 102.

First Embodiment

Figure 2:
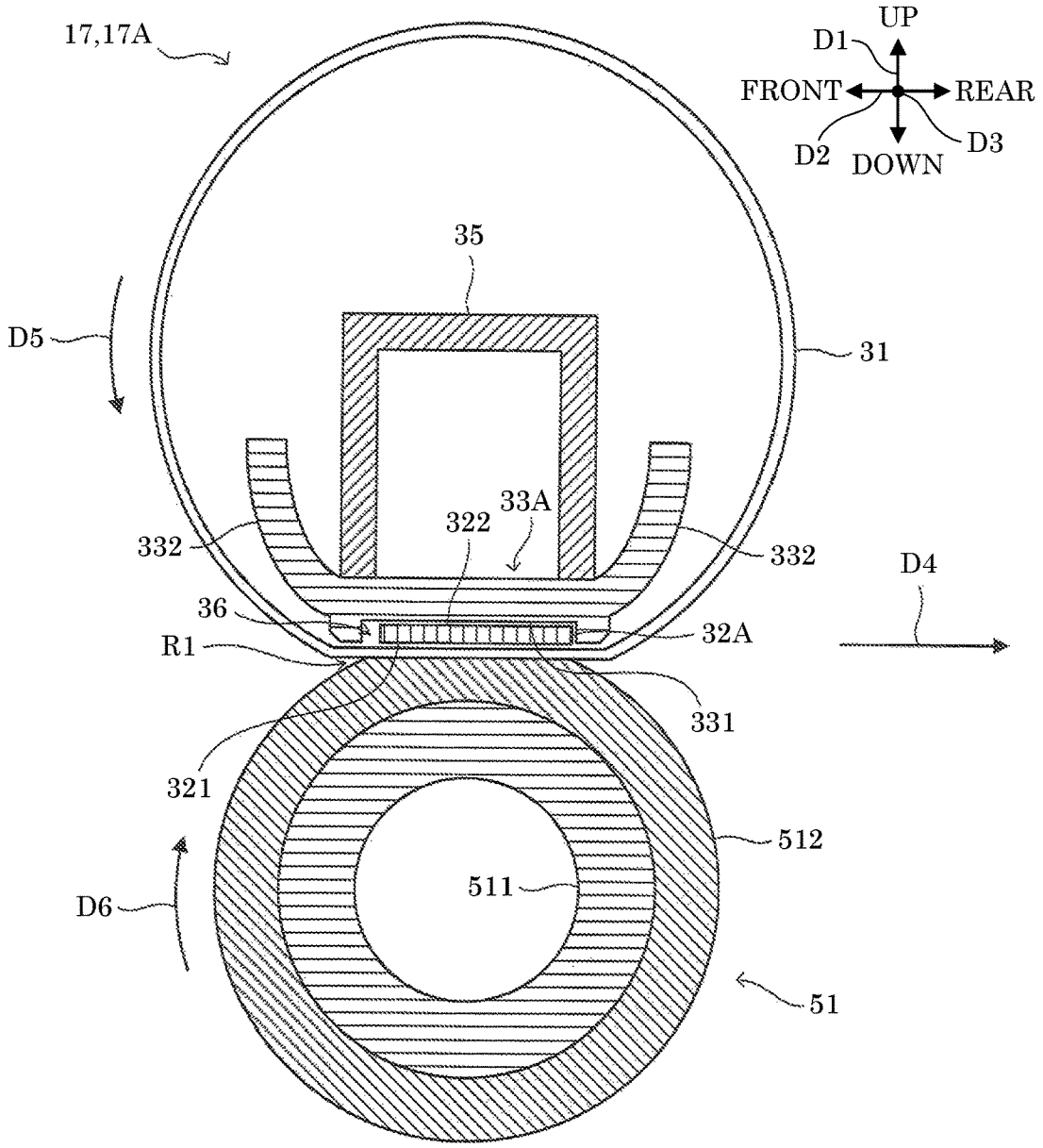
FIG. 2 is a diagram showing a configuration of a fixing device according to a first embodiment of the present disclosure.
Figure 3:
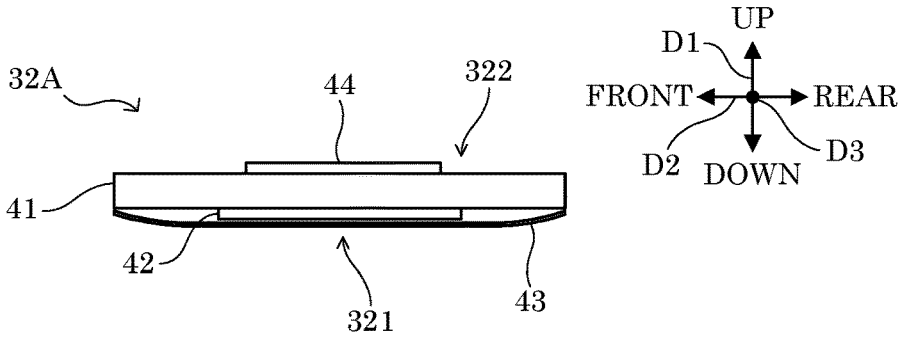
FIG. 3 is a diagram showing a configuration of a heater according to the first embodiment of the present disclosure.
Figure 4:
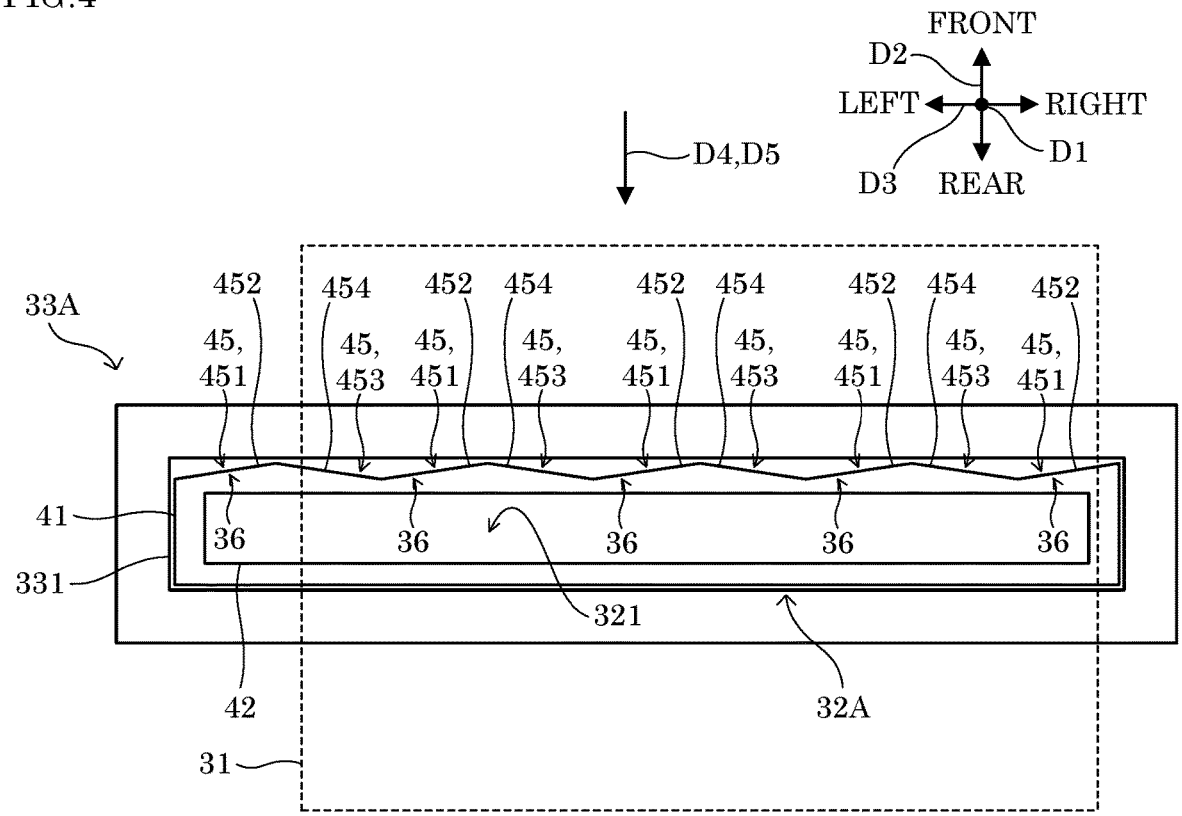
FIG. 4 is a diagram showing a configuration of the heater and a heater support portion according to the first embodiment of the present disclosure.
Figure 5:
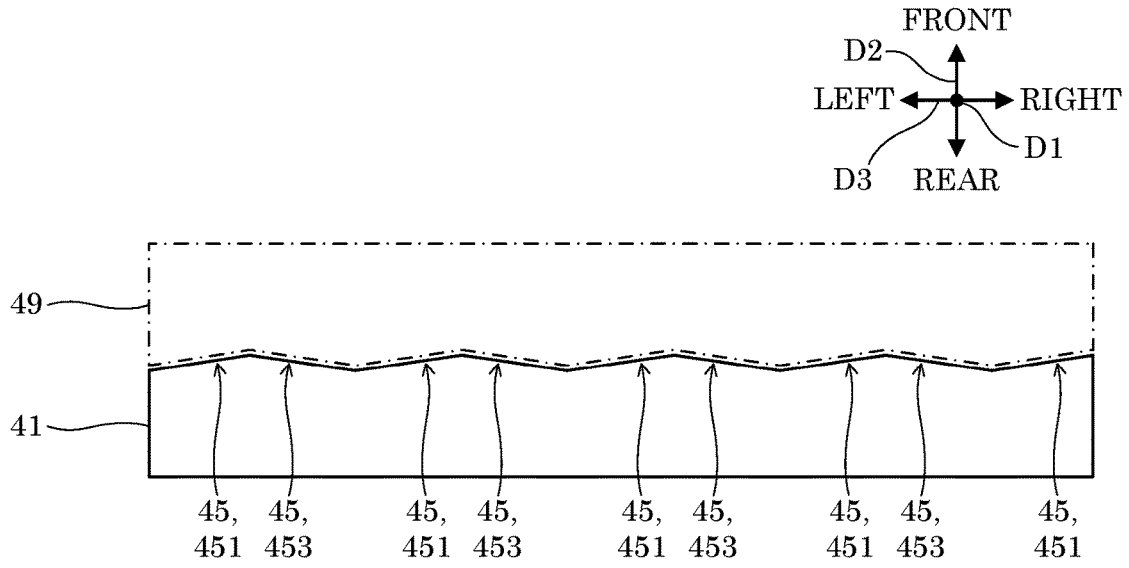
FIG. 5 is a diagram showing a configuration of a substrate of the heater according to the first embodiment of the present disclosure.

Next, with reference to FIG. 2 to FIG. 5, a description is given of a configuration of a fixing device 17A according to a first embodiment of the present disclosure. Here, FIG. 2 is a cross-sectional diagram showing a configuration of the fixing device 17A. FIG. 3 is a cross-sectional diagram showing a configuration of a heater 32A. FIG. 4 is a bottom diagram showing a configuration of the heater 32A and a heater support portion 33A. FIG. 5 is a bottom diagram showing a configuration of a substrate 41. It is noted that the dotted line in FIG. 4 indicates a fixing belt 31. In addition, the one-dot chain line in FIG. 5 indicates a substrate 49 that has the same shape as the substrate 41.

As shown in FIG. 2, the fixing device 17A includes the fixing belt 31, the heater 32A, the heater support portion 33A, a pressing member 35, reserving portions 36, and a pressure roller 51.

The fixing belt 31, while in a state of being heated by the heater 32A, comes in contact with a sheet to which a toner image has been transferred, and thereby fixes the toner image to the sheet. The fixing belt 31 is flexible and has an endless shape. As shown in FIG. 2, the fixing belt 31 is held between the heater 32A and the pressure roller 51 and runs in a running direction D5 following the rotation of the pressure roller 51. The fixing belt 31 is guided by a guide portion 332 of the heater support portion 33A and a guide member (not shown), to run along a running path.

The heater 32A heats the fixing belt 31 from an inner side of the fixing belt 31. As shown in FIG. 3, the heater 32A includes a substrate 41, a heating element 42, a protection layer 43, and a sensor 44.

As shown in FIG. 3 and FIG. 4, the substrate 41 is formed in a shape of a flat plate elongated in the left-right direction D3 that matches the width direction of the fixing belt 31. The heating element 42 is mounted on a surface of the substrate 41. As shown in FIG. 3 and FIG. 4, the heating element 42 is formed in a shape of a flat plate elongated in the longitudinal direction of the substrate 41. The heating element 42 is connected to a power supply (not shown) via a wiring pattern mounted on the substrate 41. The heating element 42 is heated by the passage of an electric current supplied from the power supply. The protection layer 43 covers a surface of the substrate 41 on which the heating element 42 is mounted, thereby protecting the surface of the substrate 41. The outer surface of the protection layer 43 constitutes a contact surface 321 (an example of a first surface of the present disclosure) of the heater 32A that comes in contact with the fixing belt 31. The sensor 44 is mounted on a surface of the substrate 41 that is opposite from the surface on which the heating element 42 is mounted. The sensor 44 outputs an electric signal that varies depending on the temperature of the heating element 42. The electric signal output from the sensor 44 is input to a control portion (not shown). The control portion controls the temperature of the heating element 42 based on the electric signal input from the sensor 44.

The heater 32A is mounted on the inner side of the fixing belt 31 to face the pressure roller 51. Specifically, the heater 32A is mounted in a posture where the contact surface 321 faces the axial center of the pressure roller 51. In addition, the heater 32A is pressed by the pressing member 35 toward the pressure roller 51, and pressed against an inner peripheral surface of the fixing belt 31. This forms a nip region R1 where a sheet that passes through between the fixing belt 31 and the pressure roller 51 is pressed thereby. It is noted that in the present description, the nip region R1 is defined as a region where the fixing belt 31 and the pressure roller 51 are in contact with each other. A lubricant is applied to the contact surface 321 of the heater 32A to reduce the friction coefficient between the contact surface 321 and the inner peripheral surface of the fixing belt 31. For example, fluorine grease is used as the lubricant.

The heater support portion 33A supports the heater 32A. As shown in FIG. 4, the heater support portion 33A is formed to be elongated in the left-right direction D3. A recessed portion 331 is formed on a lower surface of the heater support portion 33A so that the heater 32A is fitted in the recessed portion 331. The recessed portion 331 includes a bottom surface of a rectangular shape and side walls respectively erected on the sides of the bottom surface. In a state where the heater 32A is fitted in the recessed portion 331, a supported surface 322 (an example of a second surface of the present disclosure) is in contact with the bottom surface of the recessed portion 331, wherein the supported surface 322 is a surface of the substrate 41 on which the sensor 44 is mounted. In addition, as shown in FIG. 4, in the state where the heater 32A is fitted in the recessed portion 331, opposite end portions of the heater 32A in the front-rear direction D2 and opposite end portions of the heater 32A in the left-right direction D3 are in contact with the side walls of the recessed portion 331. The recessed portion 331 is formed such that its depth is approximately the same as the thickness of the heater 32A. As a result, in the state where the heater 32A fitted in the recessed portion 331, the contact surface 321 of the heater 32A is approximately flush with the edge portion of the recessed portion 331.

The heater support portion 33A guides the fixing belt 31 to run along the running path. Specifically, guide portions 332 are provided at opposite ends of the heater support portion 33A in the front-rear direction D2. The guide portions 332 come in contact with the inner peripheral surface of the fixing belt 31 to guide the fixing belt 31 to run along the running path.

The pressing member 35 presses the heater support portion 33A toward the pressure roller 51. The pressing member 35 is mounted in contact with an upper surface of the heater support portion 33A, and elongated in the left-right direction D3 that matches the width direction of the fixing belt 31. In addition, opposite end portions of the pressing member 35 in the longitudinal direction are supported by a pair of side plates (not shown) provided in the housing 101 such that the pressing member 35 can move in the up-down direction D1. The pressing member 35 receives a downward biasing force, namely a biasing force toward the pressure roller 51, from a biasing member (not shown). This causes the pressing member 35 to press the heater support portion 33A toward the pressure roller 51. As the heater support portion 33A is pressed toward the pressure roller 51, the heater 32A supported by the heater support portion 33A is also pressed toward the pressure roller 51.

The pressure roller 51 is provided below the fixing belt 31 to be in contact with an outer peripheral surface of the fixing belt 31. The pressure roller 51 includes a shaft portion 511 and an elastic layer 512, wherein the shaft portion 511 is made of a metal, and the elastic layer 512 is elastic and formed on the outer periphery of the shaft portion 511. The shaft portion 511 is rotatably supported by the pair of side plates. Upon receiving a rotational driving force from a motor (not shown), the pressure roller 51 rotates in a rotation direction D6.

Meanwhile, a friction force that acts between the contact surface 321 of the heater 32A and the fixing belt 31 may increase when the lubricant applied to the contact surface 321 reduces. When the friction force increases, a problem may occur such as a noise, a disorder of print images, or a step-out of a driving portion that drives the pressure roller 51. There is known, as a related technology, a fixing device that can restrict the increase of the friction force acting between the contact surface 321 and the fixing belt 31, by rotating the pressure roller 51 in the reverse direction to return the lubricant that has flowed out of the contact surface 321, to the contact surface 321.

However, in the fixing device of the related technology, the rotation control of the pressure roller 51 is complicated. On the other hand, the fixing device 17A according to the first embodiment of the present disclosure can restrict the increase of the friction force that acts between the contact surface 321 and the fixing belt 31, without making the rotation control of the pressure roller 51 complicated, as described in the following.

The reserving portions 36 are provided within a contact range of the heater 32A and the fixing belt 31, each of the reserving portions 36 having a reserving space for reserving the lubricant, wherein at least a part of the reserving space on the fixing belt 31 side is open. Specifically, as shown in FIG. 2 and FIG. 4, the reserving portions 36 are recessed portions formed by the recessed portion 331 of the heater support portion 33A and cut portions 45 formed on the substrate 41.

Here, as shown in FIG. 4 and FIG. 5, a plurality of cut portions 45 are formed on the substrate 41 of the heater 32A. Specifically, the plurality of cut portions 45 are formed in line along the left-right direction D3 at an upstream end of the substrate 41 in the running direction D5.

As shown in FIG. 4 and FIG. 5, each of the cut portions 45 includes a first cut portion 451 and a second cut portion 453. As shown in FIG. 4, the first cut portion 451 includes a first wall surface 452 that faces in a direction between a direction opposite to the running direction D5 and the left (an example of a first direction of the present disclosure). The first wall surface 452 is a flat surface. The second cut portion 453 includes a second wall surface 454 that faces in a direction between the direction opposite to the running direction D5 and the right (an example of a second direction of the present disclosure). The second wall surface 454 is a flat surface. In the substrate 41, the plurality of cut portions 45 are formed such that the first wall surface 452 and the second wall surface 454 continue alternately in the left-right direction D3.

In the fixing device 17A, when the lubricant that has adhered to the inner peripheral surface of the fixing belt 31 flows from the upstream in the running direction D5 to the contact surface 321, the lubricant is scraped by the edge portions of the reserving portions 36 and is reserved in the reserving portions 36. Specifically, the lubricant that has adhered to the inner peripheral surface of the fixing belt 31 is scraped by corner portions formed of the contact surface 321 and the first wall surfaces 452, and corner portions formed of the contact surface 321 and the second wall surfaces 454, and is reserved in the reserving portions 36. In addition, in the fixing device 17A, the fixing belt 31 supplies the lubricant reserved in the reserving portions 36 to the contact surface 321. Specifically, the fixing belt 31 supplies the lubricant to the contact surface 321 by conveying the lubricant that has adhered to the inner peripheral surface thereof at a region facing the reserving portions 36, toward the downstream in the running direction D5. This restricts reduction of the amount of the lubricant that has adhered to the contact surface 321, the reduction accompanied by the increase of the number of prints, and restricts increase of the friction force that acts between the heater 32A and the fixing belt 31.

Here, in the fixing device 17A, the reserving portions 36 are provided at an upstream end of the heater 32A in the running direction D5 of the fixing belt 31. Specifically, the reserving portions 36 are formed of the recessed portion 331 of the heater support portion 33A and an upstream end portion of the substrate 41 in the running direction D5. As a result, compared with a case where the reserving portions 36 are provided downstream of the upstream end of the heater 32A in the running direction D5 of the fixing belt 31, it is possible to widen the range in which the reserving portions 36 supply the lubricant. It is noted that the reserving portions 36 may be hole portions formed in the upstream end portion of the substrate 41 in the running direction D5, or hole portions formed downstream of the end portion of the substrate 41. In addition, the reserving portions 36 may be formed by reserving spaces formed inside the substrate 41, and communication ports communicating the reserving spaces with the outside of the substrate 41.

In addition, the substrate 41 includes the plurality of cut portions 45 formed in line along the left-right direction D3 that matches the width direction of the fixing belt 31, and a plurality of reserving portions 36 are formed by the plurality of cut portions 45. This restricts an adhering amount of the lubricant on the contact surface 321 from being varied in the width direction of the fixing belt 31. It is noted that the number of the cut portions 45 provided in the substrate 41 may be one.

In addition, the substrate 41 is obtained by cutting a large substrate along a triangular-wave cutting line, into two small substrates of the same shape. As a result, as shown in FIG. 5, a specific end portion of the substrate 41 including the plurality of cut portions 45 is fitted with the specific end portion of another substrate 49 that has the same shape as the substrate 41. With the substrate 41 formed in this way, compared with a case where the cut portions 45 are formed by cutting an end portion of a flat-plate substrate, it is possible to avoid generating cut pieces that become waste. It is noted that the substrate 41 may be obtained by cutting a large substrate along a sine-wave cutting line or a rectangular-wave cutting line, into two small substrates of the same shape. In addition, the substrate 41 may be formed in a shape in which the specific end portion is not fitted with the specific end portion of another substrate.

In addition, as shown in FIG. 4, the fixing belt 31 and the heater 32A are arranged in a positional relation where: the right end portion of the fixing belt 31 faces a corner portion that is formed of a surface of the substrate 41 (a surface on which the heating element 42 is mounted) and the first wall surface 452; and the left end portion of the fixing belt 31 faces a corner portion that is formed of the surface of the substrate 41 and the second wall surface 454. With this configuration, the lubricant that has adhered to the inner peripheral surface of the fixing belt 31 at the right end is shifted to the inside of the fixing belt 31 by the corner portion that is formed of the surface of the substrate 41 and the first wall surface 452, and is scraped off. In addition, the lubricant that has adhered to the inner peripheral surface of the fixing belt 31 at the left end is shifted to the inside of the fixing belt 31 by the corner portion that is formed of the surface of the substrate 41 and the second wall surface 454, and is scraped off. Accordingly, it is possible to prevent the lubricant from flowing to the outside of the fixing belt 31 in the left-right direction D3. It is noted that the fixing belt 31 and the heater 32A may be arranged in a positional relation different from the above-described positional relation.

Second Embodiment

Figure 6:
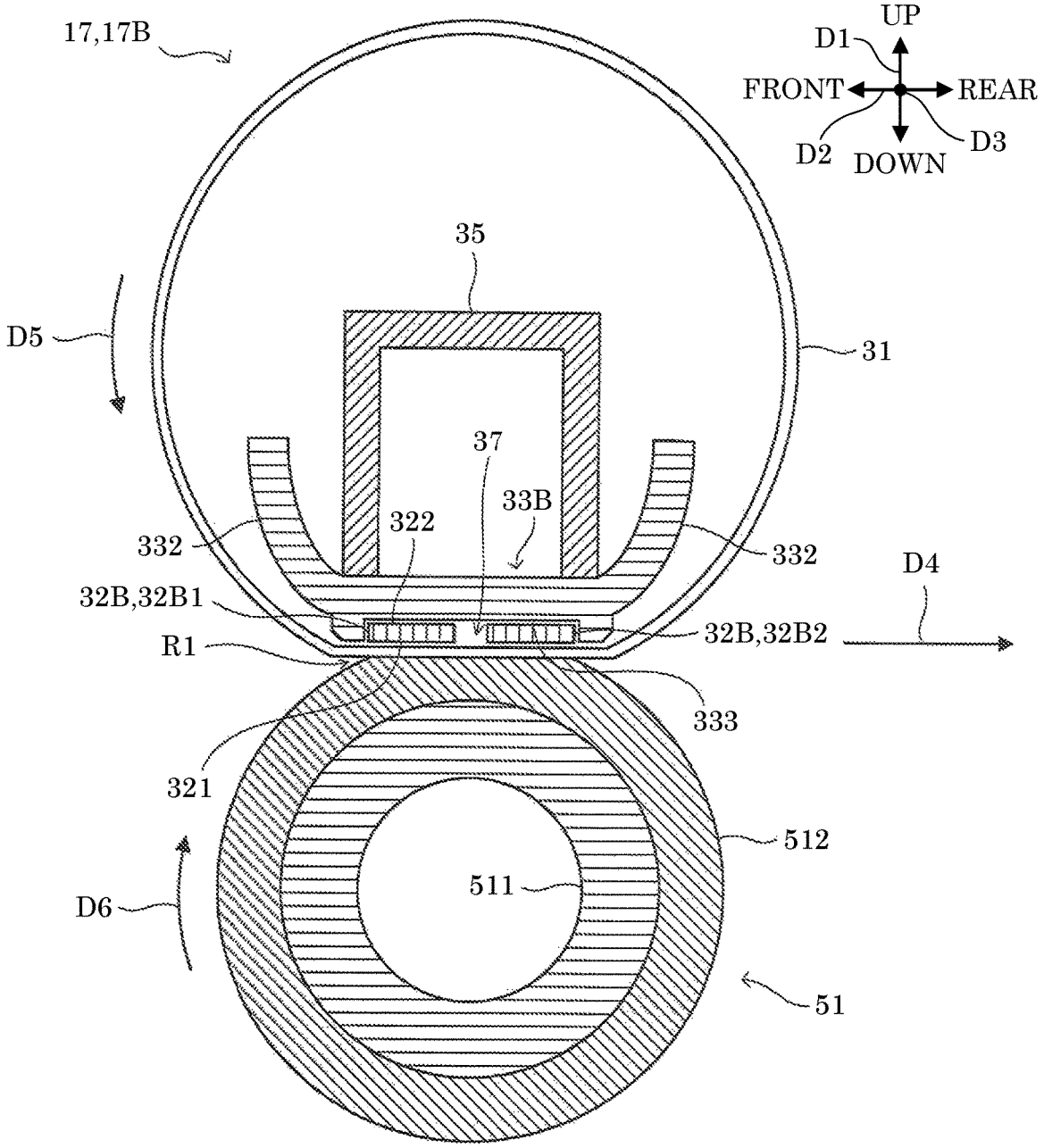
FIG. 6 is a diagram showing a configuration of a fixing device according to a second embodiment of the present disclosure.
Figure 7:
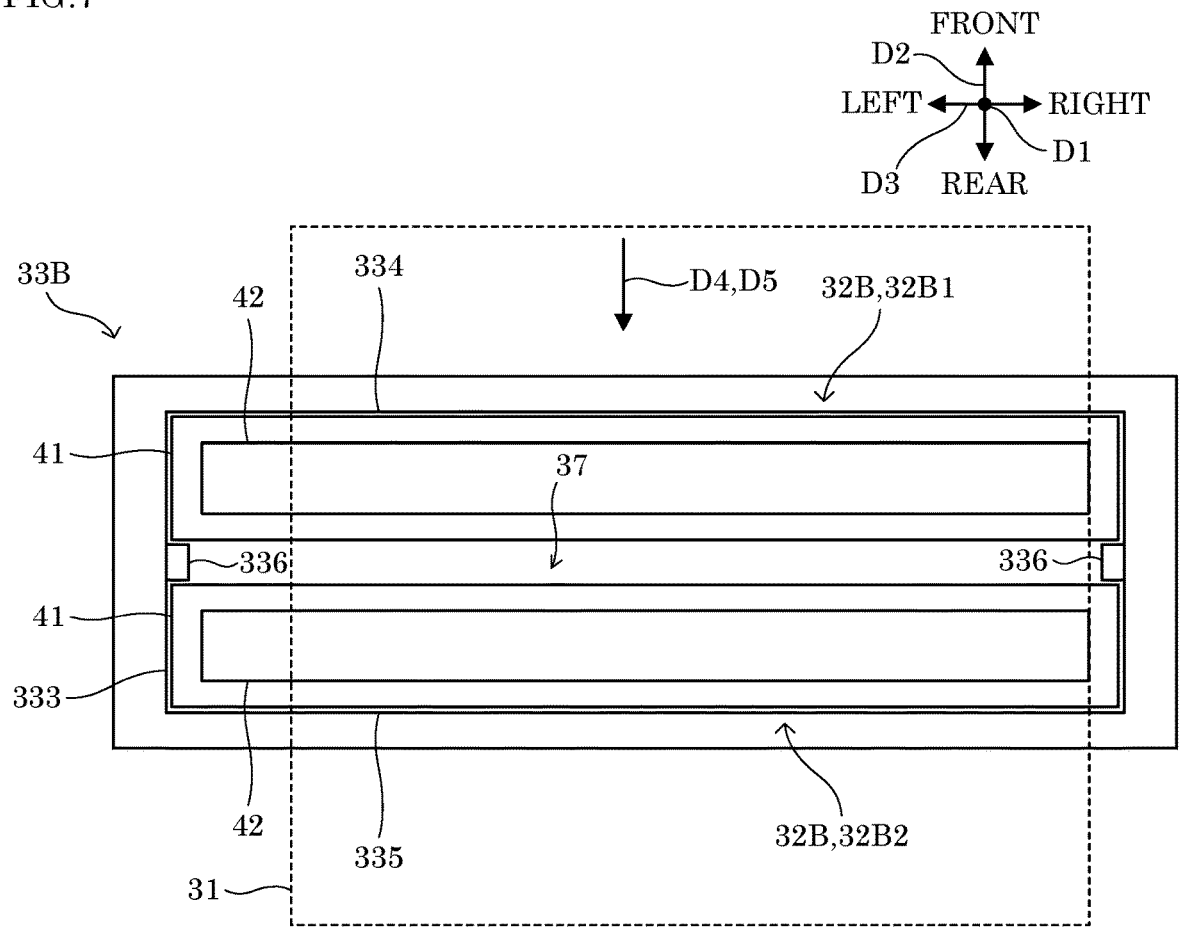
FIG. 7 is a diagram showing a configuration of a heater and a heater support portion according to the second embodiment of the present disclosure.

Next, with reference to FIG. 6 and FIG. 7, a description is given of a configuration of a fixing device 17B according to a second embodiment of the present disclosure. Here, FIG. 6 is a cross-sectional diagram showing a configuration of the fixing device 17B. FIG. 7 is a bottom diagram showing a configuration of a heater 32B1, a heater 32B2, and a heater support portion 33B.

The fixing device 17B has the same configuration as the fixing device 17A except that it includes two heaters 32B in place of the heater 32A, the heater support portion 33B in place of the heater support portion 33A, and a reserving portion 37 in place of the reserving portions 36.

Similar to the fixing device 17A, the fixing device 17B can restrict the increase of the friction force that acts between the heaters 32B and the fixing belt 31, without making the rotation control of the pressure roller 51 complicated.

Each of the heaters 32B has the same configuration as the heater 32A except that it is smaller than the heater 32A in size in the front-rear direction D2.

As shown in FIG. 6, the two heaters 32B are provided in line along the running direction D5 inside the fixing belt 31. In addition, the two heaters 32B are mounted to face the pressure roller 51. Specifically, the two heaters 32B are mounted in a posture where the contact surfaces 321 thereof face the pressure roller 51 and are parallel to each other. The two heaters 32B are pressed by the pressing member 35 toward the pressure roller 51, and pressed against the inner peripheral surface of the fixing belt 31. A lubricant is applied to the contact surfaces 321 of the two heaters 32B.

The heater support portion 33B has the same configuration as the heater support portion 33A except that it includes a recessed portion 333 in place of the recessed portion 331. The heater support portion 33B supports both of the heaters 32B.

The recessed portion 333 is formed to store the two heaters 32B. The recessed portion 333 includes a bottom surface of a rectangular shape and side walls respectively erected on the sides of the bottom surface. As shown in FIG. 7, the length of the recessed portion 333 in the left-right direction D3 is approximately the same as that of each of the heaters 32B. In addition, the recessed portion 333 is formed such that its length in the front-rear direction D2 is longer, by a predetermined distance, than twice the length of each of the heaters 32B in the front-rear direction D2.

In a state where the two heaters 32B are stored in the recessed portion 333, the supported surfaces 322 of the substrates 41 are in contact with the bottom surface of the recessed portion 333. In addition, as shown in FIG. 7, in the state where the two heaters 32B are stored in the recessed portion 333, opposite end portions of the heaters 32B in the left-right direction D3 are in contact with the side walls of the recessed portion 333 that face each other in the left-right direction D3. In addition, as shown in FIG. 7, in the state where the two heaters 32B are stored in the recessed portion 333, an end portion of the heater 32B1 is in contact with a front side wall 334 of the recessed portion 333, wherein the heater 32B1 is one of the two heaters 32B and is disposed on the upstream side in the running direction D5. In addition, as shown in FIG. 7, in the state where the two heaters 32B are stored in the recessed portion 333, an end portion of the heater 32B2 is in contact with a rear side wall 335 of the recessed portion 333, wherein the heater 32B2 is the other of the two heaters 32B and is disposed on the downstream side in the running direction D5. The recessed portion 333 is formed such that its depth is approximately the same as the thickness of each of the heaters 32B. As a result, in the state where the two heaters 32B are stored in the recessed portion 333, the contact surfaces 321 of the heaters 32B are approximately flush with the edge portion of the recessed portion 333.

The reserving portion 37 has a reserving space for reserving the lubricant between the two heaters 32B, and at least a part of the reserving space on the fixing belt 31 side is open. Specifically, as shown in FIG. 6 and FIG. 7, the reserving portion 37 is a recessed portion that is formed by: two end portions of the two heaters 32B that face each other; and the recessed portion 333 of the heater support portion 33B.

In the fixing device 17B, when the lubricant that has adhered to the inner peripheral surface of the fixing belt 31 passes a region where the fixing belt 31 faces the reserving portion 37, the lubricant is scraped by an edge portion of the reserving portion 37 that is on the downstream side in the running direction D5, and is reserved in the reserving portion 37. As is the case with the fixing device 17A, this restricts reduction of the amount of the lubricant adhering to the contact surface 321, the reduction accompanied by the increase of the number of prints, and restricts increase of the friction force that acts between the heater 32A and the fixing belt 31. In addition, in the fixing device 17B, the reserving portion 37 is provided at a position facing the center of the nip region R1. As a result, compared with the fixing device 17A in which the reserving portions 36 face the upstream portion of the nip region R1 in the running direction D5, it is possible to increase the amount of the lubricant reserved in the reserving portion.

Here, in the fixing device 17B, the reserving portion 37 is formed of; the two end portions of the two heaters 32B that face each other; and the heater support portion 33B. As a result, compared with a configuration where the reserving portion 37 is formed of only the heater support portion 33B, it is possible to simplify the shape of the heater support portion 33B. It is noted that the reserving portion 37 may be formed of only the heater support portion 33B.

In addition, as shown in FIG. 7, the heater support portion 33B includes two restriction portions 336. The two restriction portions 336, provided between the two heaters 32B, restrict the two heaters 32B from moving in directions along the running direction D5. Specifically, the two restriction portions 336 are projection portions that project from opposite side walls of the recessed portion 333 that face each other in the left-right direction D3, toward the inside in the left-right direction D3. This prevents the heaters 32B from moving in the running direction D5 and reducing the lubricant reserving space in the reserving portion 37. It is noted that the heater support portion 33B may not include the two restriction portions 336.

In addition, the two restriction portions 336 restrict the two heaters 32B from moving at outside the fixing belt 31 in the width direction of the fixing belt 31. Specifically, as shown in FIG. 7, the two restriction portions 336 are provided at outside the fixing belt 31 in the width direction of the fixing belt 31. This avoids the two restriction portions 336 from interfering with reserving of the lubricant in the reserving portion 37. It is noted that the two restriction portions 336 may be provided inside the fixing belt 31 in the width direction of the fixing belt 31. In this case, the number of the restriction portions 336 may be one or three or more.

Figure 11:
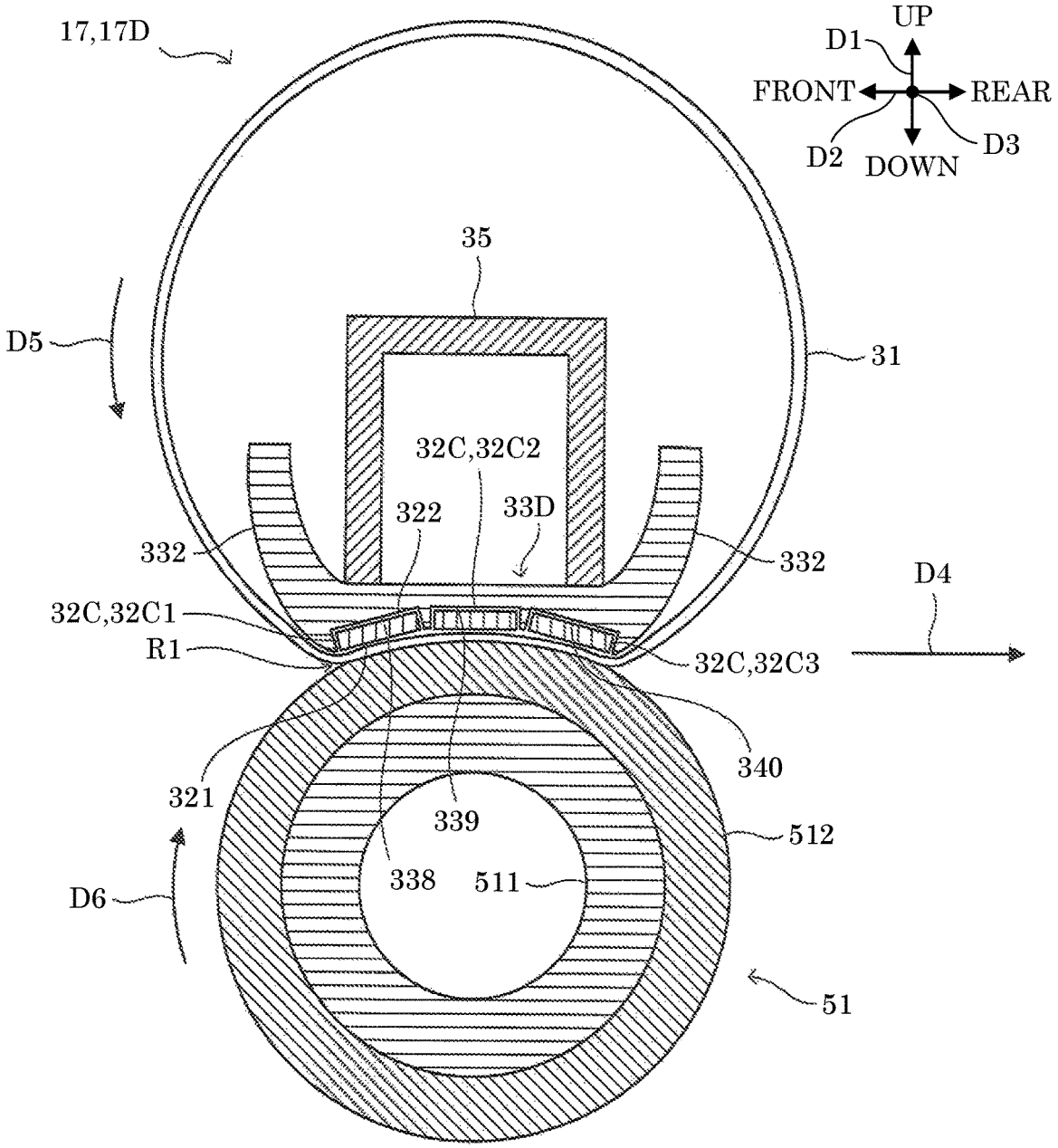
FIG. 11 is a diagram showing a configuration of a fixing device according to a fourth embodiment of the present disclosure.

It is noted that as shown in FIG. 11, in a configuration where three or more heaters are provided, the reserving portion 37 may be provided between two adjacent heaters.

Meanwhile, there is known, as a related technology, a fixing device that includes a nip forming member that is provided to face the pressure roller 51 across the fixing belt 31, wherein a lubricant is applied to a contact surface of the nip forming member that comes in contact with the fixing belt 31, and the lubricant is supplied from inside the nip forming member to the inner peripheral surface of the fixing belt 31.

Here, in the fixing device according to the related technology, it may be possible to provide a heater between the nip forming member and the fixing belt 31 to improve the heating efficiency. However, in this case, the heater interferes with supply of the lubricant from the inside of the nip forming portion to the inner peripheral surface of the fixing belt 31. On the other hand, the fixing device 17C according to the third embodiment of the present disclosure can improve the efficiency of heating the fixing belt 31 without interfering with supply of the lubricant to the inner peripheral surface of the fixing belt 31, as described in the following.

Third Embodiment

Figure 8:
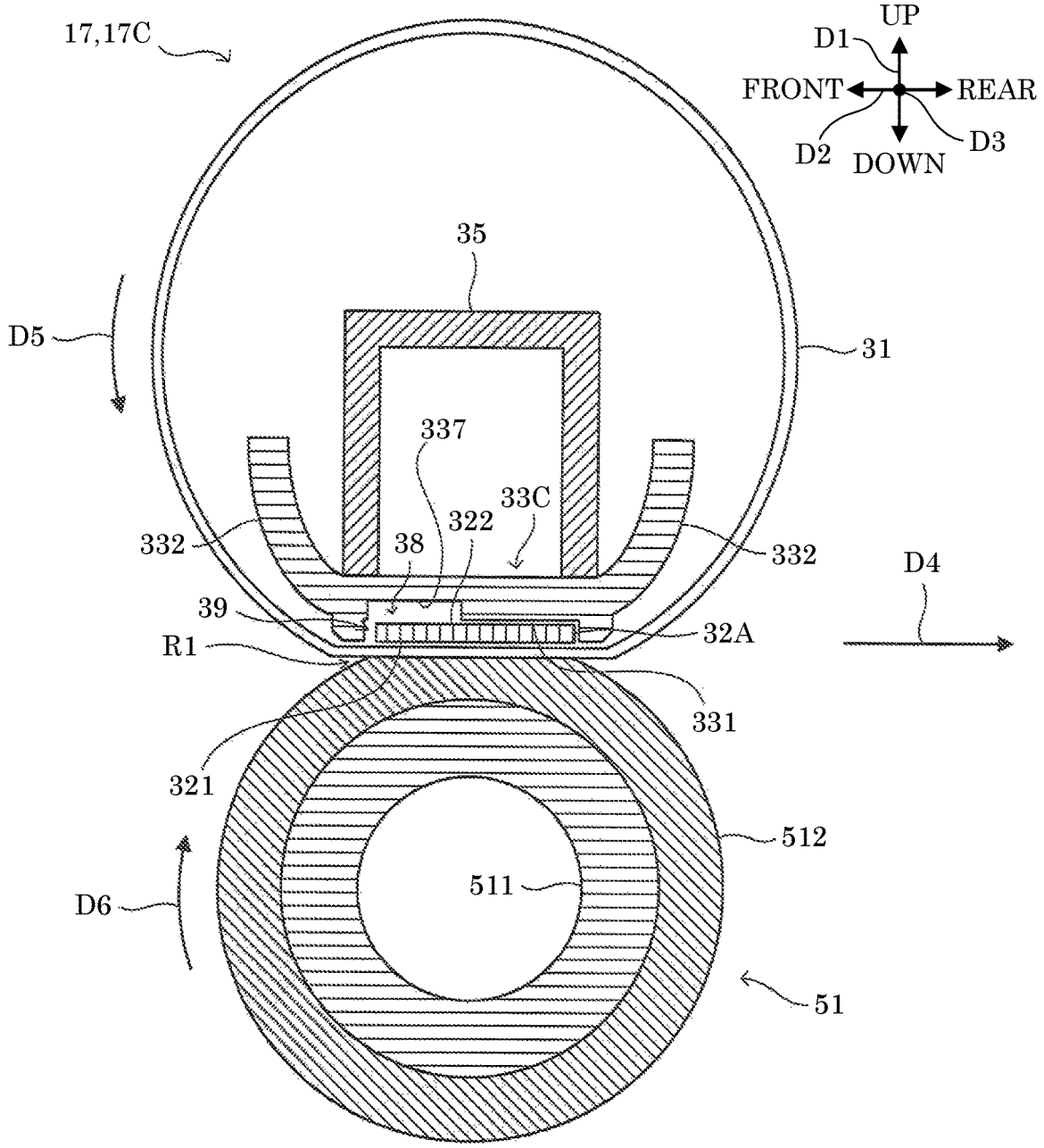
FIG. 8 is a diagram showing a configuration of a fixing device according to a third embodiment of the present disclosure.
Figure 9:
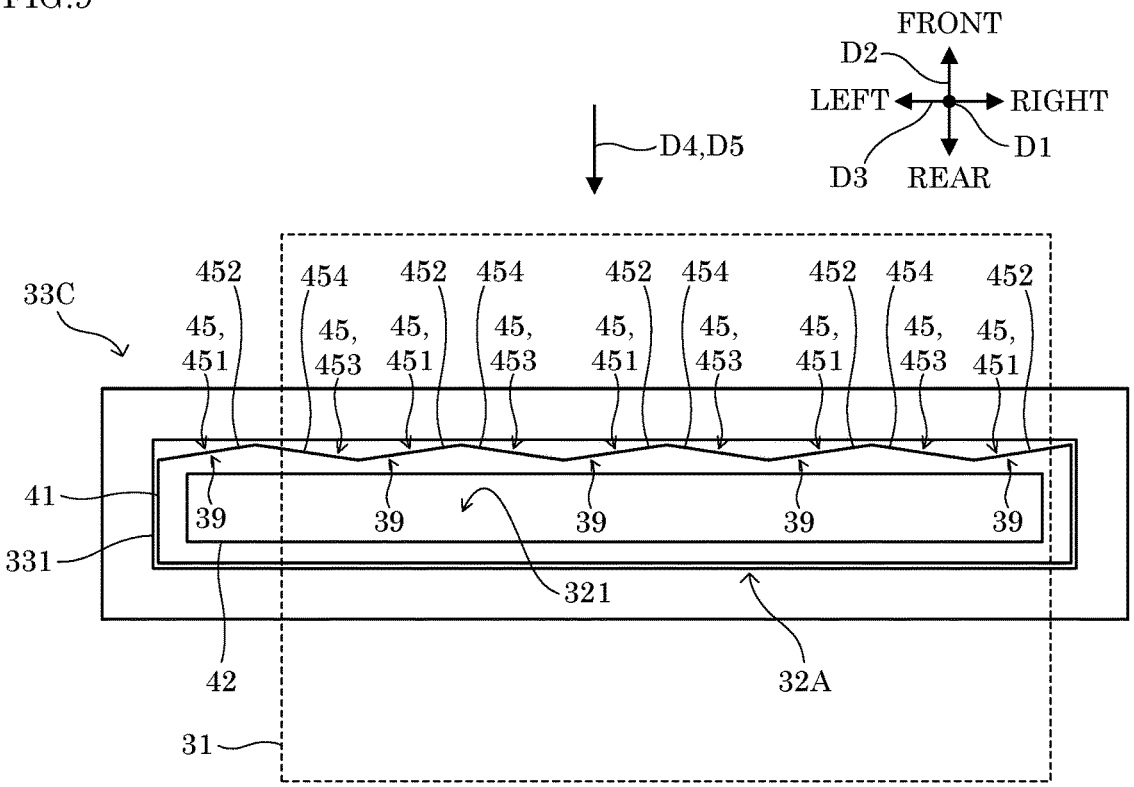
FIG. 9 is a diagram showing a configuration of a heater and a heater support portion according to the third embodiment of the present disclosure.
Figure 10:
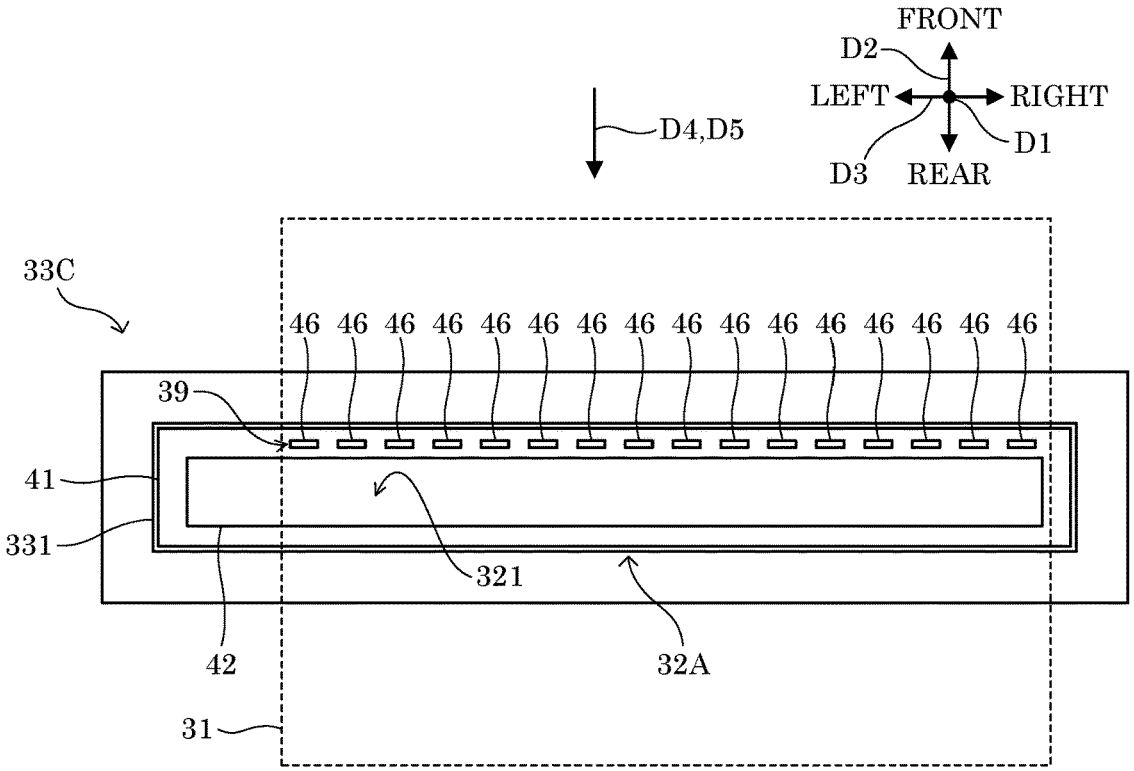
FIG. 10 is a diagram showing a modification of the fixing device according to the third embodiment of the present disclosure.

Next, with reference to FIG. 8 and FIG. 9, a description is given of a configuration of a fixing device 17C according to a third embodiment of the present disclosure. Here, FIG. 8 is a cross-sectional diagram showing a configuration of the fixing device 17C. FIG. 9 is a bottom diagram showing a configuration of the heater 32A and a heater support portion 33C.

The fixing device 17C has the same configuration as the fixing device 17A except that it includes the heater support portion 33C in place of the heater support portion 33A, a reserving portion 38 in place of the reserving portions 36, and supply paths 39.

The heater support portion 33C has the same configuration as the heater support portion 33A except that it further includes a recessed portion 337.

The recessed portion 337 is formed to be recessed from the bottom surface of the recessed portion 331 upward. The recessed portion 337 includes a bottom surface of a rectangular shape and side walls respectively erected on the sides of the bottom surface. As shown in FIG. 8, the recessed portion 337 is provided at an upstream end of the recessed portion 331 in the running direction D5. The recessed portion 337 is elongated in the left-right direction D3.

The reserving portion 38 is configured to reserve the lubricant. In the fixing device 17C, the heater 32A is provided between the reserving portion 38 and the fixing belt 31. Specifically, the reserving portion 38 is formed by the recessed portion 337 of the heater support portion 33C, and the supported surface 322 of the heater 32A. The lubricant is reserved in the reserving portion 38 in advance.

The supply paths 39 form moving paths in which the lubricant moves from the reserving portion 38 toward the pressure roller 51. Specifically, as shown in FIG. 8 and FIG. 9, the supply paths 39 are formed by: the recessed portion 331 of the heater support portion 33C; and the cut portions 45 formed on the substrate 41.

In the fixing device 17C, the lubricant reserved in the reserving portion 38 is supplied to the contact surface 321 via the supply paths 39 formed at the heater 32A. This makes it possible to improve the heating efficiency of the fixing belt 31 without interfering with the supply of the lubricant to the inner peripheral surface of the fixing belt 31.

Here, in the fixing device 17C, the reserving portion 38 is formed of the recessed portion 337 of the heater support portion 33C and the supported surface 322 of the heater 32A. As a result, compared with a configuration where the reserving portion 38 is formed of only the heater support portion 33C, it is possible to simplify the shape of the heater support portion 33C. It is noted that the reserving portion 38 may be formed of only the heater support portion 33C. In this case, the heater support portion 33C may have paths that connect the reserving portion 38 to the supply paths 39.

Here, in the fixing device 17C, the supply paths 39 are provided at an upstream end of the heater 32A in the running direction D5 of the fixing belt 31. Specifically, the supply paths 39 are formed of the recessed portion 331 of the heater support portion 33C and an upstream end portion of the substrate 41 in the running direction D5. As a result, compared with a case where the supply paths 39 are provided downstream of the upstream end of the heater 32A in the running direction D5 of the fixing belt 31, it is possible to widen the range in which the supply paths 39 supply the lubricant. It is noted that the reserving portions 36 may be hole portions 46 formed in the upstream end portion of the substrate 41 in the running direction D5. The hole portions 46 may be formed downstream of the upstream end portion of the substrate 41 in the running direction D5.

In addition, the substrate 41 includes the plurality of cut portions 45 that are formed in line along the left-right direction D3 that matches the width direction of the fixing belt 31. This restricts the adhering amount of the lubricant on the contact surface 321 from being varied in the width direction of the fixing belt 31. It is noted that the number of the cut portions 45 provided in the substrate 41 may be one.

In addition, as shown in FIG. 9, the fixing belt 31 and the heater 32A are arranged in a positional relation where: the right end portion of the fixing belt 31 faces a corner portion that is formed of a surface of the substrate 41 (a surface on which the heating element 42 is mounted) and the first wall surface 452; and the left end portion of the fixing belt 31 faces a corner portion that is formed of the surface of the substrate 41 and the second wall surface 454. With this configuration, as is the case with the fixing device 17A, it is possible to prevent the lubricant from flowing to the outside of the fixing belt 31 in the left-right direction D3. It is noted that the fixing belt 31 and the heater 32A may be arranged in a positional relation different from the above-described positional relation.

Meanwhile, when a sheet is conveyed to be passed through the fixing device 17A at a very high speed, the toner is insufficiently melted in the nip region R1, and quality of a print image on the sheet is degraded. With regard to this problem, the roller diameter of the pressure roller 51 may be increased so that the nip region R1 is expanded in the sheet conveyance direction D4, and the heating time period and the pressing time period in the nip region R1 are increased. However, this enlarges the fixing device 17A. On the other hand, a fixing device 17D according to a fourth embodiment of the present disclosure can increase the sheet conveyance speed without enlarging the device, as described in the following.

Fourth Embodiment

Next, with reference to FIG. 11, a description is given of a configuration of the fixing device 17D according to the fourth embodiment of the present disclosure. Here, FIG. 11 is a cross-sectional diagram showing a configuration of the fixing device 17D.

The fixing device 17D has the same configuration as the fixing device 17A except that it includes three heaters 32C in place of the heater 32A, and a heater support portion 33D in place of the heater support portion 33A, and does not include the reserving portions 36.

Each of the heaters 32C has the same configuration as the heater 32A except that it is smaller than the heater 32A in size in the short direction.

As shown in FIG. 11, the three heaters 32C are provided inside the fixing belt 31, in line along the outer peripheral surface of the pressure roller 51. In addition, each of the three heaters 32C is mounted to face the axial center of the pressure roller 51. That is, each of the three heaters 32C is mounted in a posture where a straight line perpendicular to the contact surface 321 passes through the axial center of the pressure roller 51. For example, each of the three heaters 32C is mounted in a posture where a straight line that is perpendicular to the contact surface 321 and passes through a center of the contact surface 321 in the short direction, passes through the axial center of the pressure roller 51. Each of the three heaters 32C is pressed by the pressing member 35 toward the pressure roller 51, and pressed against the inner peripheral surface of the fixing belt 31. A lubricant is applied to the contact surfaces 321 of each of the three heaters 32C.

The heater support portion 33D has the same configuration as the heater support portion 33A except that it includes recessed portions 338, 339, and 340 in place of the recessed portion 331.

The recessed portion 338 is configured to be fitted with a heater 32C1 that is, among the three heaters 32C, positioned most upstream in the running direction D5. The recessed portion 338 includes a bottom surface of a rectangular shape and side walls respectively erected on the sides of the bottom surface. As shown in FIG. 11, the bottom surface of the recessed portion 338 is inclined to face the axial center of the pressure roller 51, with respect to a plane that includes the front-rear direction D2 and the left-right direction D3. In a state where the heater 32C1 is fitted in the recessed portion 338, the supported surface 322 of the substrate 41 is in contact with the bottom surface of the recessed portion 338. In addition, in the state where the heater 32C1 is fitted in the recessed portion 338, opposite end portions in the longitudinal direction and opposite end portions in the short direction of the heater 32C1 are in contact with the side walls of the recessed portion 338. The recessed portion 338 is formed such that its depth is approximately the same as the thickness of the heater 32C1. As a result, in the state where the heater 32C1 is fitted in the recessed portion 338, the contact surface 321 of the heater 32C1 is approximately flush with the edge portion of the recessed portion 338.

The recessed portion 339 is configured to be fitted with a heater 32C2 that is adjacent to the heater 32C1 among the three heaters 32C. The recessed portion 339 includes a bottom surface of a rectangular shape and side walls respectively erected on the sides of the bottom surface. As shown in FIG. 11, the bottom surface of the recessed portion 338 is approximately parallel to the plane that includes the front-rear direction D2 and the left-right direction D3 such that the bottom surface faces the axial center of the pressure roller 51. In a state where the heater 32C2 is fitted in the recessed portion 339, the supported surface 322 of the substrate 41 is in contact with the bottom surface of the recessed portion 339. In addition, in the state where the heater 32C2 is fitted in the recessed portion 339, opposite end portions in the longitudinal direction and opposite end portions in the short direction of the heater 32C2 are in contact with the side walls of the recessed portion 339. The recessed portion 339 is formed such that its depth is approximately the same as the thickness of the heater 32C2. As a result, in the state where the heater 32C2 is fitted in the recessed portion 339, the contact surface 321 of the heater 32C2 is approximately flush with the edge portion of the recessed portion 339.

The recessed portion 340 is configured to be fitted with a heater 32C3 that is, among the three heaters 32C, positioned most downstream in the running direction D5. The recessed portion 340 includes a bottom surface of a rectangular shape and side walls respectively erected on the sides of the bottom surface. As shown in FIG. 11, the bottom surface of the recessed portion 340 is inclined to face the axial center of the pressure roller 51, with respect to a plane that includes the front-rear direction D2 and the left-right direction D3. In a state where the heater 32C3 is fitted in the recessed portion 340, the supported surface 322 of the substrate 41 is in contact with the bottom surface of the recessed portion 340. In addition, in the state where the heater 32C3 is fitted in the recessed portion 340, opposite end portions in the longitudinal direction and opposite end portions in the short direction of the heater 32C3 are in contact with the side walls of the recessed portion 340. The recessed portion 340 is formed such that its depth is approximately the same as the thickness of the heater 32C3. As a result, in the state where the heater 32C3 is fitted in the recessed portion 340, the contact surface 321 of the heater 32C3 is approximately flush with the edge portion of the recessed portion 340.

In the fixing device 17D, each of the three heaters 32C is mounted in a posture where the contact surface 321 thereof faces the axial center of the pressure roller 51. Thus the three heaters 32C are arranged such that the three contact surfaces 321 thereof draw an arc along the outer peripheral surface of the pressure roller 51. As a result, it is possible to expand the nip region R1 in the sheet conveyance direction D4 without increasing the roller diameter of the pressure roller 51. Accordingly, it is possible to increase the sheet conveyance speed without enlarging the device.

Here, as shown in FIG. 11, in the fixing device 17D, the heater 32C3 that is, among the three heaters 32C, positioned most downstream in the rotation direction D6, is mounted in a posture intersecting the sheet conveyance direction D4. This increases the bending of the fixing belt 31 at a downstream end of the nip region R1 in the conveyance direction D4, thereby promoting separation of the sheet from the fixing belt 31. It is noted that the fixing device 17D may not include the heater 32C3 and the recessed portion 340.

Figure 12:
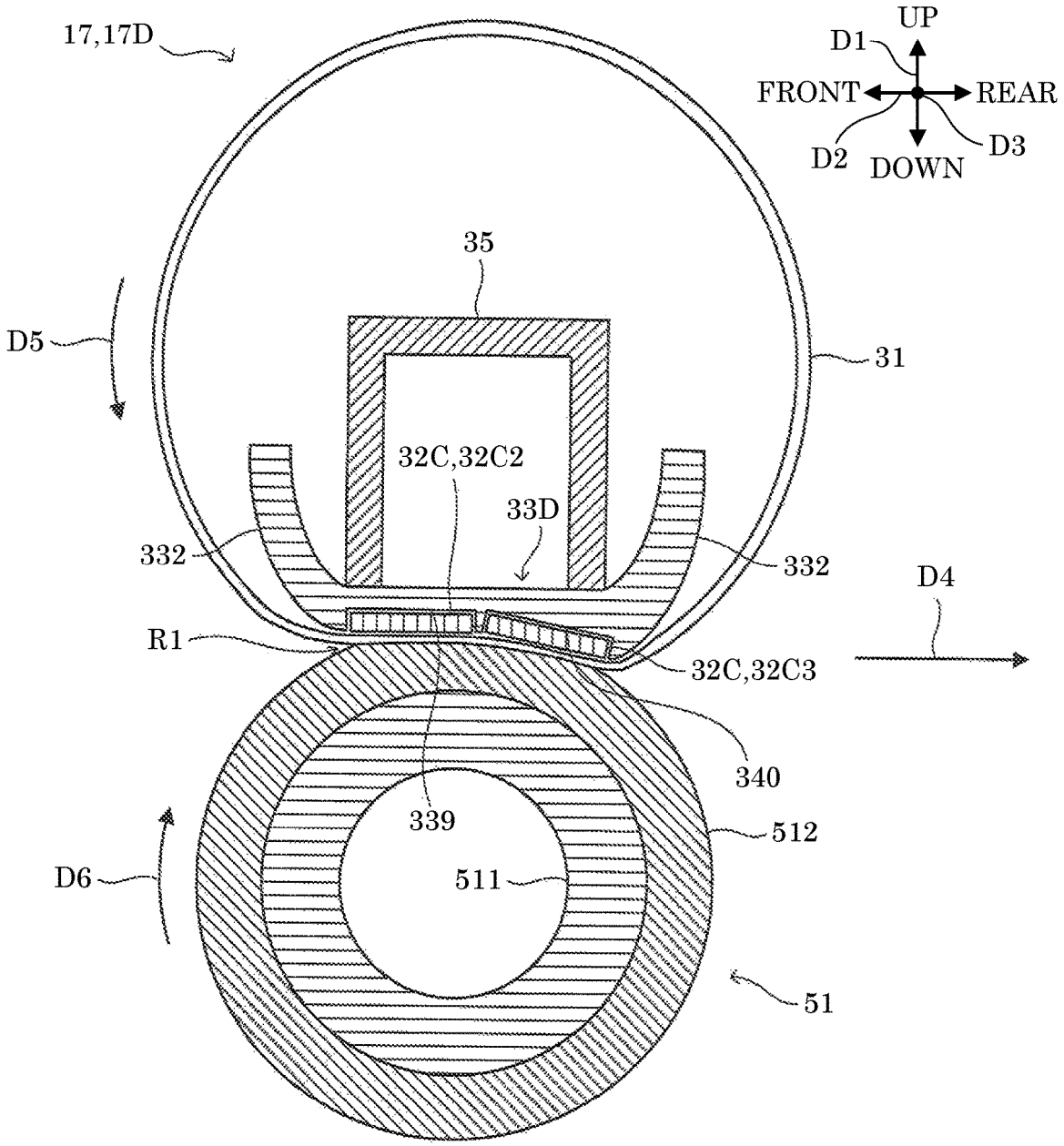
FIG. 12 is a diagram showing a modification of the fixing device according to the fourth embodiment of the present disclosure.

It is noted that, as shown in FIG. 12, the fixing device 17D may not include the heater 32C1 and the recessed portion 338. In the configuration shown in FIG. 12, the heater 32C2, one of the two heaters 32C that is positioned most upstream in the rotation direction D6, is mounted in a posture being parallel to the sheet conveyance direction D4. This helps a sheet enter the nip region R1 smoothly.

Meanwhile, there is known, as a related technology, a fixing device in which the peak of the nip pressure of the nip region R1 is set to be downstream of a center of the nip region R1 in the running direction D5 of the fixing belt 31 so that an image with high glossiness can be output.

However, in the fixing device of the related technology, the peak of the nip pressure of the nip region R1 is set to be downstream of the heater in the running direction D5, and the nip region R1 extends from the heater toward the downstream in the running direction D5. This increases the roller diameter of the pressure roller 51 that forms the nip region R1. On the other hand, a fixing device 17E according to a fifth embodiment of the present disclosure is configured to output an image with high glossiness without increasing the roller diameter of the pressure roller 51, as described in the following.

Fifth Embodiment

Figure 13:
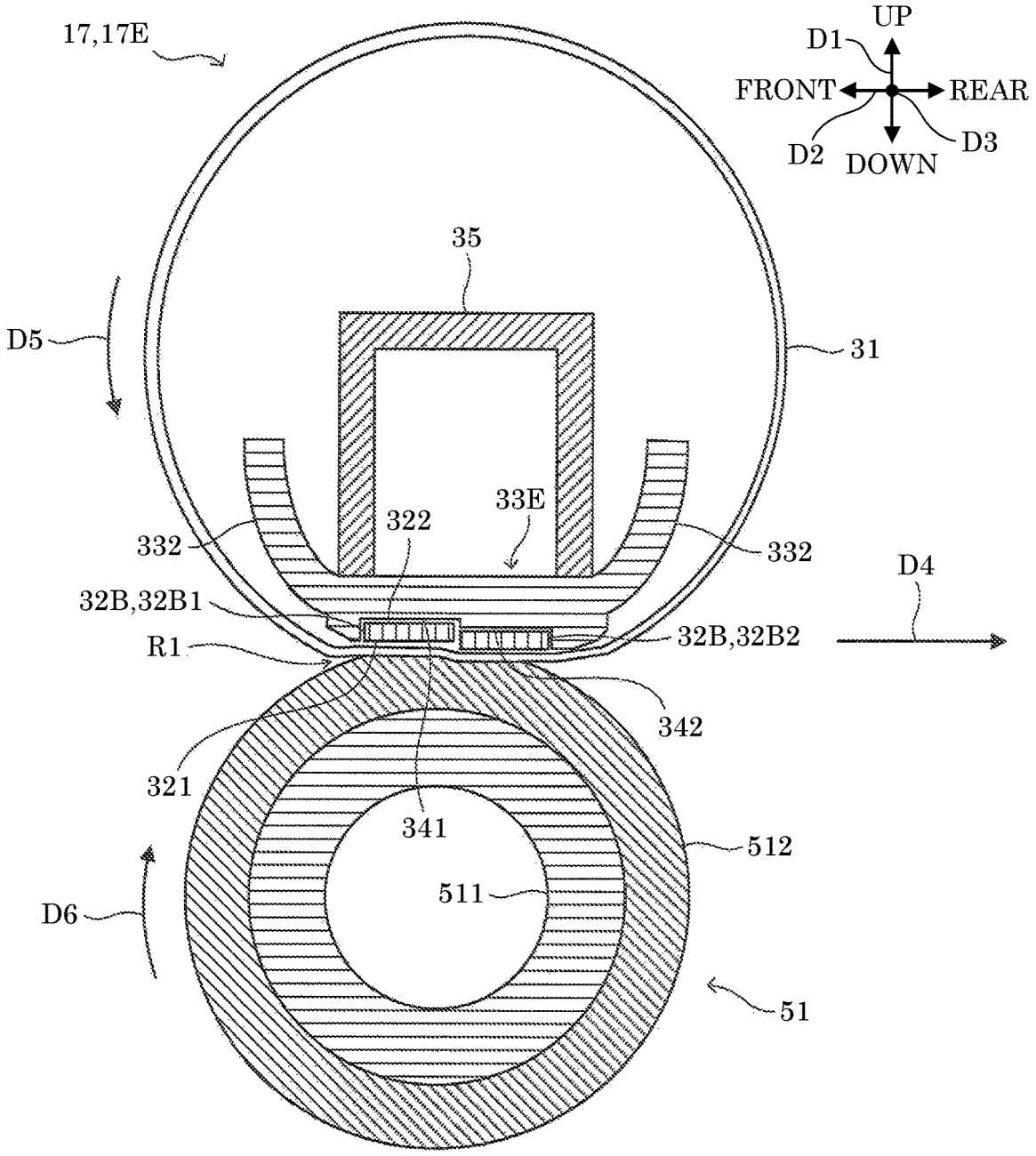
FIG. 13 is a diagram showing a configuration of a fixing device according to a fifth embodiment of the present disclosure.

Next, with reference to FIG. 13, a description is given of a configuration of the fixing device 17E according to the fifth embodiment of the present disclosure. Here, FIG. 13 is a cross-sectional diagram showing a configuration of the fixing device 17E.

The fixing device 17E has the same configuration as the fixing device 17A except that it includes two heaters 32B in place of the heater 32A, and a heater support portion 33E in place of the heater support portion 33A, and does not include the reserving portions 36. It is noted that the heaters 32B included in the fixing device 17E are the same as the heaters 32B included in the fixing device 17B.

The two heaters 32B are arranged in line along the running direction D5 to be pressed against the inner peripheral surface of the fixing belt 31 in a positional relation where the peak of the nip pressure of the nip region R1 is downstream of a center of the nip region R1 in the running direction D5 of the fixing belt 31. Specifically, as shown in FIG. 13, the two heaters 32B are mounted in a posture where the contact surfaces 321 thereof face the pressure roller 51 and are parallel to each other. In addition, among the two heaters 32B, a heater 32B2 is downstream of a heater 32B1 in the running direction D5, and the contact surface 321 of the heater 32B2 projects toward the pressure roller 51 more than the contact surface 321 of the heater 32B1. The two heaters 32B are arranged such that end portions of the two heaters 32B facing each other are in contact with each other, and a contact portion where the end portions are in contact with each other is downstream of the axial center of the pressure roller 51 in the running direction D5. The two heaters 32B are pressed by the pressing member 35 toward the pressure roller 51, and pressed against the inner peripheral surface of the fixing belt 31. A lubricant is applied to the contact surfaces 321 of the two heaters 32B.

The heater support portion 33E has the same configuration as the heater support portion 33A except that it includes a recessed portion 341 (an example of a first support portion of the present disclosure) and a recessed portion 342 (an example of a second support portion of the present disclosure) in place of the recessed portion 331.

The recessed portion 341 comes in contact with the supported surface 322 of the heater 32B1 to support the heater 32B1. The recessed portion 341 is formed to store the heater 32B1. The recessed portion 341 includes a bottom surface of a rectangular shape and side walls respectively erected on the sides of the bottom surface. As shown in FIG. 13, a side wall of the recessed portion 341 that is on the downstream side in the running direction D5 continues to the bottom surface of the recessed portion 342. The recessed portion 341 and the heater 32B1 have approximately the same length in the left-right direction D3. In addition, the recessed portion 341 and the heater 32B1 have approximately the same length in the front-rear direction D2. In a state where the heater 32B1 is stored in the recessed portion 341, the supported surface 322 of the substrate 41 comes in contact with a bottom surface of the recessed portion 341. In addition, in the state where the heater 32B1 is stored in the recessed portion 341, opposite end portions in the longitudinal direction and opposite end portions in the short direction of the heater 32B1 are in contact with the side walls of the recessed portion 341.

The recessed portion 342 comes in contact with the supported surface 322 of the heater 32B2 at a position more on the pressure roller 51 side than the recessed portion 341 to support the heater 32B2. The recessed portion 342 is formed to store the heater 32B2. The recessed portion 342 includes a bottom surface of a rectangular shape and side walls respectively erected on the sides of the bottom surface except for a side on the upstream side in the running direction D5. As shown in FIG. 13, the bottom surface of the recessed portion 342 projects toward the pressure roller 51 more than the bottom surface of the recessed portion 341. The recessed portion 342 and the heater 32B2 have approximately the same length in the left-right direction D3. In addition, the recessed portion 342 and the heater 32B2 have approximately the same length in the front-rear direction D2. In a state where the heater 32B2 is stored in the recessed portion 342, the supported surface 322 of the substrate 41 comes in contact with a bottom surface of the recessed portion 342. In addition, in the state where the heater 32B2 is stored in the recessed portion 342, opposite end portions in the longitudinal direction and opposite end portions in the short direction of the heater 32B2 are in contact with the side walls of the recessed portion 342.

In the fixing device 17E, the positional relation between the two heaters 32B sets the peak of the nip pressure of the nip region R1 to be downstream of the center of the nip region R1 in the running direction D5 of the fixing belt 31. This configuration makes it possible to output an image with high glossiness without increasing the roller diameter of the pressure roller 51.

Figure 14:
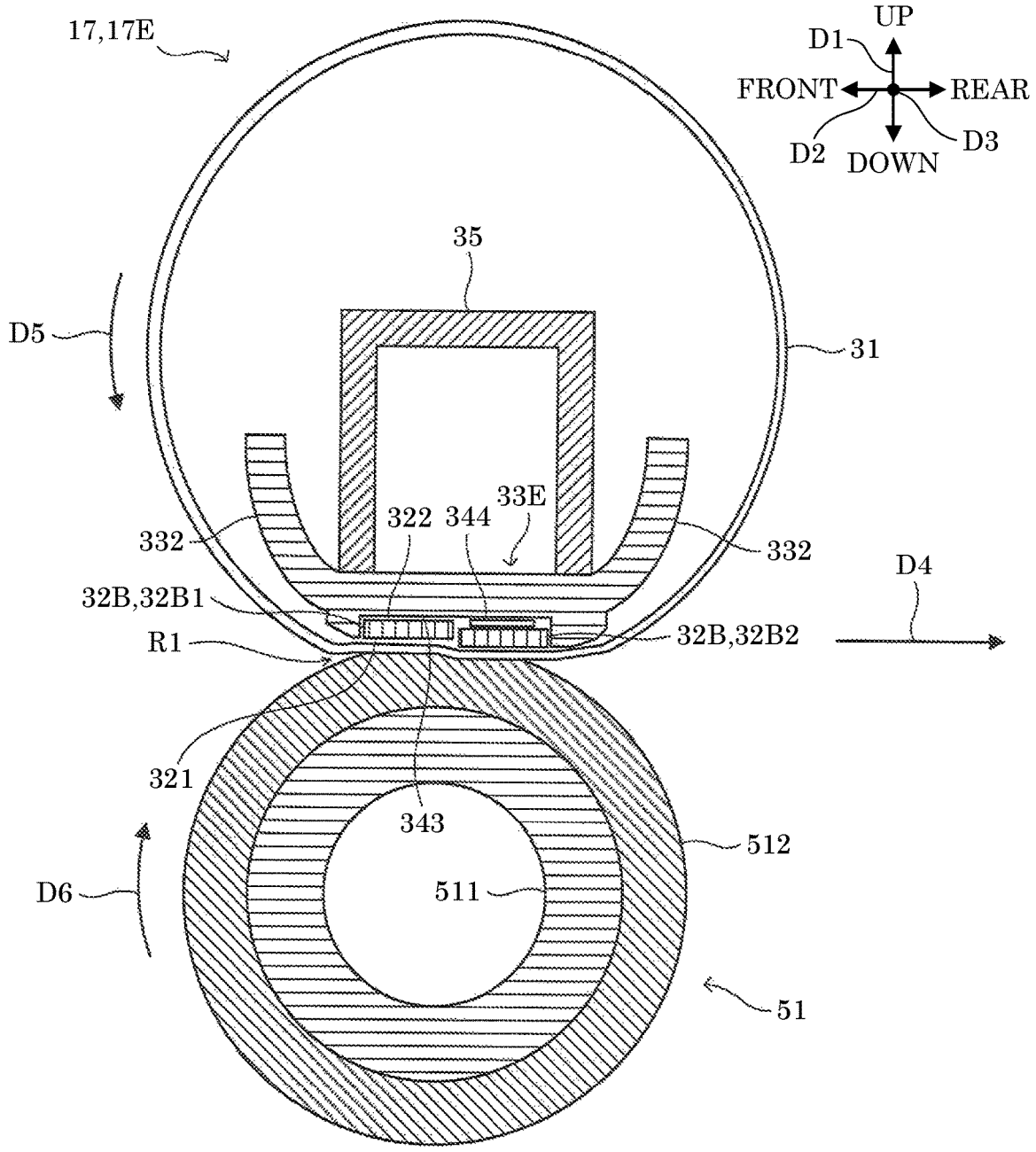
FIG. 14 is a diagram showing a modification of the fixing device according to the fifth embodiment of the present disclosure.

It is noted that, as shown in FIG. 14, the fixing device 17E may include a recessed portion 343 (an example of a support portion of the present disclosure) in place of the recessed portions 341 and 342, and may further include a spacer 344. The recessed portion 343 is formed by the recessed portion 341 and the recessed portion 342, wherein the bottom surfaces of the recessed portion 341 and the recessed portion 342 are flush with each other. The spacer 344 is provided between the bottom surface of the recessed portion 343 and the heater 32B2. This allows the contact surface 321 of the heater 32B2 to project toward the pressure roller 51 more than the contact surface 321 of the heater 32B1. With this configuration, too, the peak of the nip pressure of the nip region R1 is set to be downstream of the center of the nip region R1 in the running direction D5 of the fixing belt 31. It is noted that instead of providing the spacer 344, the heater 32B2 may be formed to be thicker than the heater 32B1.

In addition, the two heaters 32B may be mounted in a posture where the contact surfaces 321 thereof are not parallel to each other. For example, as shown in FIG. 12, the two heaters 32B may be arranged in a posture where the contact surfaces 321 thereof respectively face the axial center of the pressure roller 51. In this case, the heater 32B2 positioned on the downstream side in the running direction D5 is mounted to project toward the pressure roller 51 more than the heater 32B1. With this configuration, too, it is possible to set the peak of the nip pressure of the nip region R1 to be downstream of the center of the nip region R1 in the running direction D5 of the fixing belt 31.

Meanwhile, there is known, as a related technology, a fixing device in which the heating element 42 is divided in its longitudinal direction into a plurality of heating portions, and energization of each of the plurality of heating portions can be controlled.

Here, in the fixing device of the related technology, in order to execute a temperature control for each of the heating portions, it is necessary to provide as many sensors as the heating portions on the back surface of the substrate 41. However, the number of sensors that can be arranged on the back surface of the substrate 41 is limited. As a result, in the fixing device of the related technology, since it is not possible to provides more heating portions than sensors that can be arranged on the back surface of the substrate 41, the number of divisions of the heating element 42 is limited. On the other hand, in a fixing device 17F according to a sixth embodiment of the present disclosure, it is possible to increase the number of divisions of the heating element 42, as described in the following.

Sixth Embodiment

Figure 15:
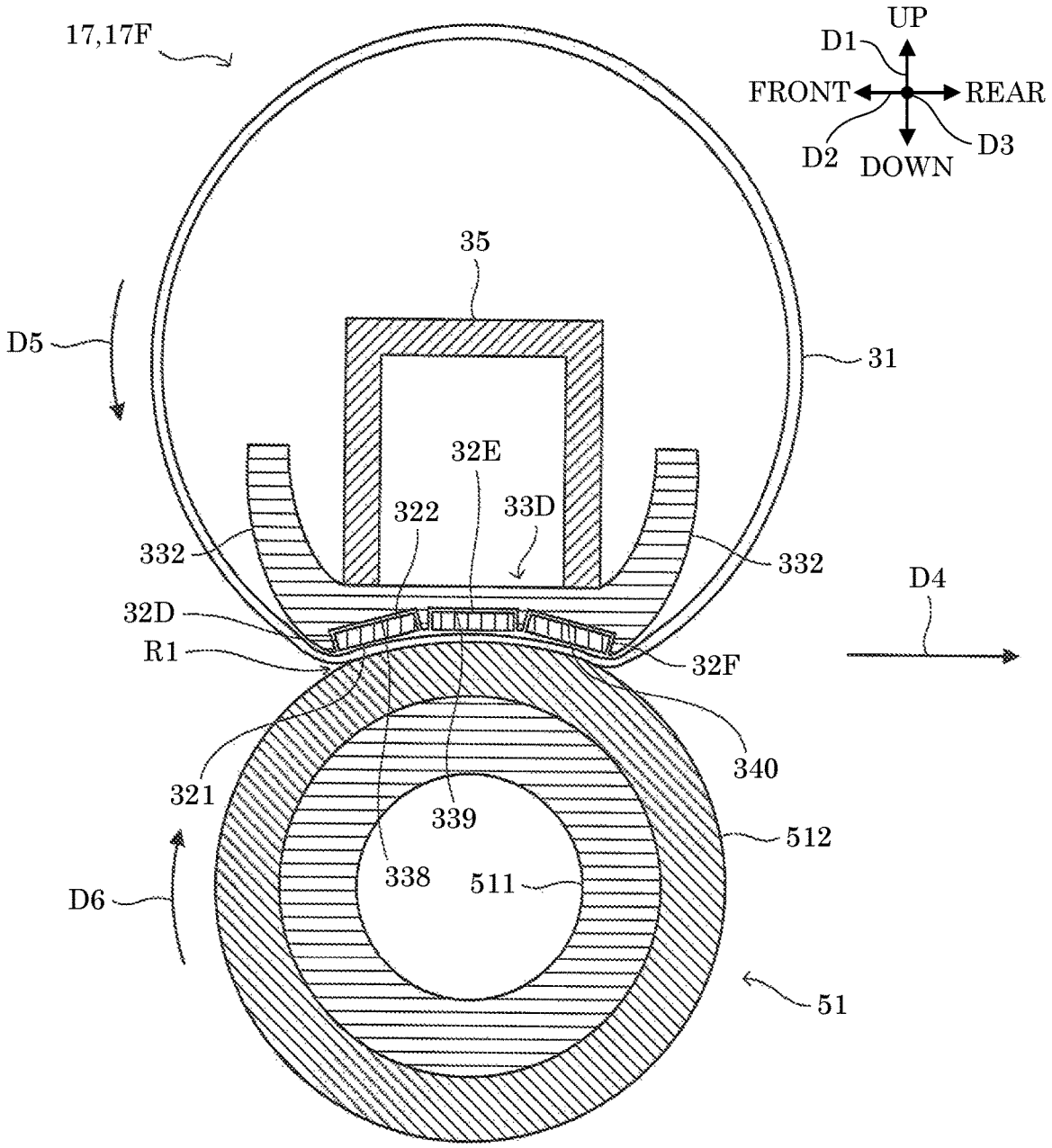
FIG. 15 is a diagram showing a configuration of a fixing device according to a sixth embodiment of the present disclosure.
Figure 16:
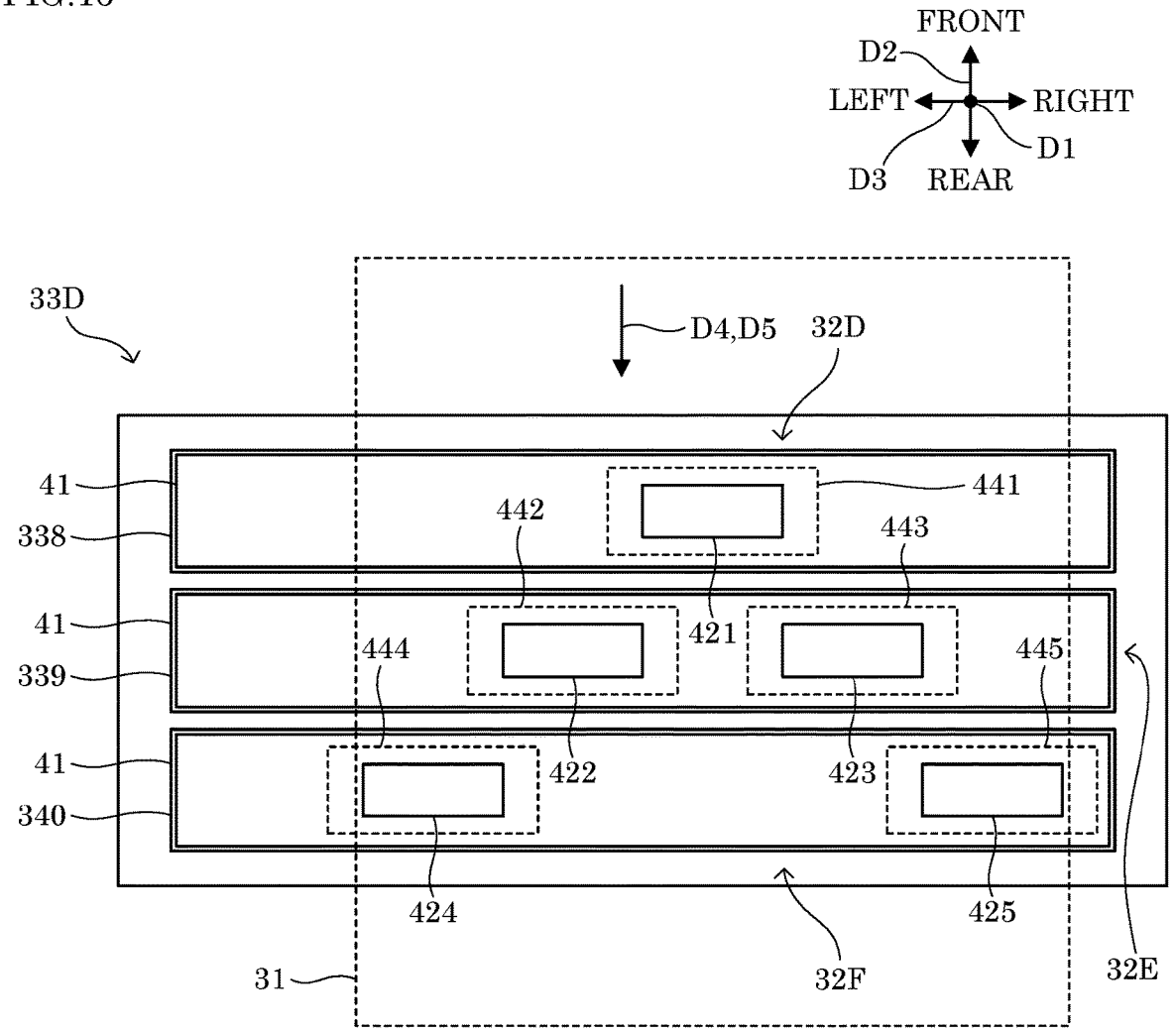
FIG. 16 is a diagram showing a configuration of a heater and a heater support portion according to the sixth embodiment of the present disclosure.

Next, with reference to FIG. 15 and FIG. 16, a description is given of a configuration of the fixing device 17F according to the sixth embodiment of the present disclosure. Here, FIG. 15 is a cross-sectional diagram showing a configuration of the fixing device 17F. FIG. 16 is a bottom diagram showing a configuration of heaters 32D, 32E, and 32F, and the heater support portion 33D.

The fixing device 17F has the same configuration as the fixing device 17A except that it includes the heaters 32D, 32E, and 32F in place of the heater 32A, and the heater support portion 33D in place of the heater support portion 33A, and does not include the reserving portions 36. It is noted that the heater support portion 33D is the same as the heater support portion 33D included in the fixing device 17D.

The heaters 32D, 32E, and 32F include heating portions 421 to 425 formed by dividing the heating element 42. As shown in FIG. 16, in the fixing device 17F, the heating portions are provided in the heaters 32D, 32E, and 32F at different positions in the left-right direction D3 that matches the width direction of the fixing belt 31.

As shown in FIG. 15, the heaters 32D, 32E, and 32F are provided inside the fixing belt 31, in line along the outer peripheral surface of the pressure roller 51. In addition, each of the heaters 32D, 32E, and 32F is mounted to face the axial center of the pressure roller 51. Each of the heaters 32D, 32E, and 32F is pressed by the pressing member 35 toward the pressure roller 51, and pressed against the inner peripheral surface of the fixing belt 31. A lubricant is applied to the contact surfaces 321 of each of the heaters 32D, 32E, and 32F.

The heater 32D has the same configuration as the heater 32A except that it is smaller than the heater 32A in size in the short direction, and it includes a heating portion 421 in place of the heating element 42, and a sensor 441 in place of the sensor 44. The heating portion 421 is heated when energized. As shown in FIG. 16, the heating portion 421 is provided in a region of the substrate 41 that faces the fixing belt 31, at the center of the region in the left-right direction D3. The sensor 441 corresponds to the heating portion 421, and outputs an electric signal that varies depending on the temperature of the heating portion 421.

The heater 32E has the same configuration as the heater 32A except that it is smaller than the heater 32A in size in the short direction, and it includes heating portions 422 and 423 in place of the heating element 42, and sensors 442 and 443 in place of the sensor 44. Each of the heating portions 422 and 423 is heated when energized. As shown in FIG. 16, the heating portion 422 is provided in the region of the substrate 41 that faces the fixing belt 31, at a position between the center of the region in the left-right direction D3 and the left end of the region. The heating portion 423 is provided in the region of the substrate 41 that faces the fixing belt 31, at a position between the center of the region in the left-right direction D3 and the right end of the region. The sensor 442 corresponds to the heating portion 422, and outputs an electric signal that varies depending on the temperature of the heating portion 422. The sensor 443 corresponds to the heating portion 423, and outputs an electric signal that varies depending on the temperature of the heating portion 423.

The heater 32F has the same configuration as the heater 32A except that it is smaller than the heater 32A in size in the short direction, and it includes heating portions 424 and 425 in place of the heating element 42, and sensors 444 and 445 in place of the sensor 44. Each of the heating portions 424 and 425 is heated when energized. As shown in FIG. 16, the heating portion 424 is provided in the region of the substrate 41 that faces the fixing belt 31, at the left end of the region. The heating portion 423 is provided in the region of the substrate 41 that faces the fixing belt 31, at the right end of the region. The sensor 444 corresponds to the heating portion 424, and outputs an electric signal that varies depending on the temperature of the heating portion 424. The sensor 445 corresponds to the heating portion 425, and outputs an electric signal that varies depending on the temperature of the heating portion 425.

As described above, in the fixing device 17F, the heating portions 421 to 425 are arranged in distribution in the heaters 32D, 32E, and 32F. With this configuration, compared with a configuration where all of heating portions formed by dividing the heating element 42 are arranged in one substrate, it is possible to increase the number of divisions of the heating element 42.

Here, as shown in FIG. 15, in the fixing device 17F, the heaters 32D, 32E, and 32F are disposed along the rotation direction D6 of the pressure roller 51 with a predetermined interval therebetween. With this configuration, compared with a configuration where the heaters 32D, 32E, and 32F are disposed with no interval therebetween, it is possible to restrict reduction in detection accuracy of the sensors 441 to 445 (an example of a plurality of temperature sensors of the present disclosure) caused by heat transfer in the substrate 41. It is noted that the heaters 32D, 32E, and 32F may be disposed with no interval therebetween.

As shown in FIG. 15, in the fixing device 17F, the heaters 32D, 32E, and 32F are mounted in a posture where the contact surfaces 321 thereof face the axial center of the pressure roller 51. With this configuration, it is possible to increase the number of heaters without increasing the roller diameter of the pressure roller 51.

In addition, as shown in FIG. 15, in the fixing device 17F, among the heaters 32D, 32E, and 32F, the heater 32F positioned most downstream in the rotation direction D6 is mounted in a posture intersecting the sheet conveyance direction D4. This increases the bending of the fixing belt 31 at a downstream end of the nip region R1 in the conveyance direction D4, thereby promoting separation of the sheet from the fixing belt 31. It is noted that the heaters 32D, 32E, and 32F may be disposed in a state where the contact surfaces 321 thereof are parallel to each other. In this case, among the heaters 32D, 32E, and 32F, the heater 32D positioned most upstream in the rotation direction D6 is mounted in a posture being parallel to the sheet conveyance direction D4. This helps a sheet enter the nip region R1 smoothly.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A fixing device comprising:

a fixing belt;

a pressure roller provided in contact with an outer peripheral surface of the fixing belt;

a reserving portion provided inside the fixing belt and configured to reserve a lubricant;

a heater provided between the reserving portion and the pressure roller in such a way as to be pressed against the fixing belt, wherein a moving path is formed in the heater such that the lubricant moves from the reserving portion toward the pressure roller in the moving path; and a heater support portion configured to support the heater by coming in contact with a second surface of the heater that is opposite from a first surface of the heater that comes in contact with the fixing belt, wherein the heater support portion includes a first recessed portion and a second recessed portion, wherein the heater is fitted in the first recessed portion, a bottom surface of the first recessed portion is in contact with the second surface of the heater, and the second recessed portion is formed at the bottom surface of the first recessed portion, the reserving portion is composed of the second recessed portion of the heater support portion and the second surface of the heater, and the moving path is a hole portion that passes through the first surface and the second surface of the heater.

2. An image forming apparatus for forming an image on a sheet by using the fixing device according to claim 1.

3. The fixing device according to claim 1, wherein the heater includes a substrate on which a heating element is mounted, and the hole portion is formed upstream of the heating element in the substrate in a running direction of the fixing belt.

4. The fixing device according to claim 1, wherein the substrate includes a plurality of hole portions that are formed in line along a width direction of the fixing belt.

* * * * *